US006603294B2

(12) United States Patent
Morita

(10) Patent No.: US 6,603,294 B2
(45) Date of Patent: Aug. 5, 2003

(54) VOLTAGE SUPPLYING DEVICE, AND SEMICONDUCTOR DEVICE, ELECTRO-OPTICAL DEVICE AND ELECTRONIC INSTRUMENT USING THE SAME

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/092,356

(22) Filed: Mar. 5, 2002

(65) Prior Publication Data

US 2002/0145408 A1 Oct. 10, 2002

Related U.S. Application Data

(63) Continuation-in-part of application No. 10/016,687, filed on Dec. 11, 2001, which is a continuation of application No. 09/692,740, filed on Oct. 19, 2000.

(30) Foreign Application Priority Data

Oct. 21, 1999 (JP) ..... 11-299159

(51) Int. Cl.[7] ..... G05F 1/44
(52) U.S. Cl. ..... 323/280
(58) Field of Search ..... 323/273, 280, 323/282, 283; 327/530, 538

(56) References Cited

U.S. PATENT DOCUMENTS

| | | | | | |
|---|---|---|---|---|---|
| 5,006,739 | A | * | 4/1991 | Kimura et al. | 327/112 |
| 5,243,333 | A | * | 9/1993 | Shiba et al. | 345/100 |
| 5,396,165 | A | * | 3/1995 | Hwang et al. | 323/210 |
| 6,087,885 | A | * | 7/2000 | Tobita | 327/379 |
| 6,118,261 | A | * | 9/2000 | Erdelyi et al. | 323/313 |
| 6,154,083 | A | * | 11/2000 | Gaudet et al. | 327/312 |
| 6,157,180 | A | * | 12/2000 | Kuo | 323/282 |
| 6,271,699 | B1 | * | 8/2001 | Dowlatabadi | 327/170 |

FOREIGN PATENT DOCUMENTS

| | | |
|---|---|---|
| EP | 0-837559 | 4/1998 |
| JP | 06-161570 | 6/1994 |
| JP | 10-301539 | 11/1998 |
| JP | 11-161237 | 6/1999 |
| JP | 11-164174 | 6/1999 |
| WO | 98/40873 | 9/1998 |

* cited by examiner

*Primary Examiner*—Adolf Deneke Berhane
(74) *Attorney, Agent, or Firm*—Hogan & Hartson, LLP

(57) ABSTRACT

The present invention provides a voltage supplying device which supplies a voltage to a load capacitance to finish charging the load capacitance with a predetermined voltage within a predetermined charging period. The voltage supplying device includes a voltage supplying source, an impedance conversion circuit which performs impedance conversion for a voltage from the voltage supplying source and outputs the converted voltage, a first switching element connected between the impedance conversion circuit and the load capacitance, a bypass line for bypassing the impedance conversion circuit and the first switching element and supplying a voltage from the voltage supplying source to the load capacitance, and a second switching element provided on the bypass line. The impedance conversion circuit may include a voltage follower circuit for outputting the voltage supplied from the voltage supplying source by a first current drive capability, and a booster provided at an output stage of the voltage follower circuit, for outputting a current to be added to an output of the voltage follower circuit by a second current drive capability. The first switching element is turned on and the second switching element is turned off in a first period of the charging period and a second period subsequent to the first period, and the first switching element is turned off and the second switching element is turned on in a third period of the charging period subsequent to the second period. Furthermore, in the first period, both the voltage follower circuit and the booster are driven so that a voltage is outputted from the impedance conversion circuit by the first current drive capability and the second current drive capability. Also, in the second period, the voltage follower circuit is driven so that a voltage is outputted from the impedance conversion circuit by the first current drive capability.

22 Claims, 25 Drawing Sheets

VOLTAGE SUPPLYING DEVICE, AND SEMICONDUCTOR DEVICE, ELECTRO-OPTICAL DEVICE AND ELECTRONIC INSTRUMENT USING THE SAME

This application is a continuation-in-part application of application Ser. No. 10/016,687, filed Dec. 11, 2001, which is a continuation of application Ser. No. 09/692,740 filed Oct. 19, 2000 which application is hereby incorporated by reference in its entirety.

BACKGROUND OF THE INVENTION

1. Field of the Invention

The present invention relates to a voltage supplying device, and a semiconductor device, an electro-optical device and an electronic instrument using the voltage supplying device.

2. Description of Related Art

In recent years, there are devices requiring a highly accurate voltage supply, for example, a liquid crystal display.

In an active matrix type of liquid crystal display or a simple matrix type of liquid crystal display, the number of grayscales (or colors) of a liquid crystal panel is highly improved, and a voltage to be applied is developed to be more precise.

In order to increase the number of grayscales of a liquid crystal panel, a thin film transistor (TFT) liquid crystal device which is an active matrix type of liquid crystal display uses three colors of RGB (red, green and blue) which includes data signals constituted of 6-bit data (64 grayscales, ca. 260,000 colors) or 8-bit data (256 grayscales, ca. 16,770,000 colors), for example.

With the increase in the number of grayscales and as voltage levels in many steps are necesssary in proportion to the increase, a technique of setting a voltage level more precisely is required.

According to the characteristics in relationship between the applied voltage and the panel transmittance of a liquid crystal panel, the rate of change in panel transmittance with respect to the applied voltage is large where the transmittance is in the middle level around 50%, and is decreased when the panel transmittance approaches 100% or 0%. Therefore, in the region where the panel transmittance is in the middle level, a slight deviation in the applied voltage has a great influence on a gray level. In order to suppress the change in panel transmittance, a voltage to be applied to liquid crystal is required to be supplied more precisely.

The maximum permissible level in dispersion of a voltage to be applied to liquid crystal is ±5 mV for 64 grayscales and ±1 to ±2 mV for 256 grayscales, for example, and more precise voltage is required to be applied to liquid crystal when the number of grayscales is increased. Although the dispersion in the threshold voltage VTH of an ordinary IC chip is allowed to range from several tens mV to several hundreds mV, a liquid crystal display with the increased number of grayscales has a severer maximum permissible level. It can be predicted that further increase in the number of grayscales in future requires more precise setting method for a voltage to be applied to liquid crystal.

Consequently, there are conventionally various method of generating grayscale voltages in a driving circuit of a liquid crystal panel, such as a voltage selecting method, a time sharing method, or a digital-analog conversion method.

FIG. 4 shows a conventional voltage supplying device of the method using a digital-analogue conversion device (hereinafter referred to as a DAC method).

A voltage follower circuit 72, into which an output from a DAC 70 is entered, functions as an impedance converter, and in the case of a voltage follower circuit 72 in an ideal state, a voltage of anode 201 entered into a non-inverse input terminal becomes equal to a voltage of a node 202 entered into an inverse input terminal. However, conventionally in the voltage follower circuit 72 not compensated by an offset canceling circuit, an offset is formed between the input and the output due to dispersion in performance of respective transistors, so as to form a difference in voltage between the node 201 and the node 202.

FIG. 4 shows a voltage supplying device for solving the problem. The output from the DAC 70 is supplied to the non-inverse input terminal 201 of the voltage follower circuit 72, and the output of the voltage follower circuit 72 is returned to the inverse input terminal 202. In the course of the circuit connecting the output line and the non-inverse input terminal 201, a switching element Q10, a capacitance C10 and a switching element Q12 are connected in series. On the negative feedback line connected to the inverse input terminal 202, only a switching element Q1 is present. The switching element Q10 is connected in parallel to the capacitance C10 and the switching element Q11.

In a first period, the switching element Q11 is off, and the switching element Q10 and the switching element Q12 are on, whereby an offset voltage between the input and the output of the voltage follower circuit 72 is charged in the capacitance C10. In a second period, the switching element Q11 is on, and the switching element Q10 and the switching element Q12 are off, whereby a charge of offset canceling charged in the capacitance C10 is superposed and returned to the inverse input terminal 202 of the voltage follower circuit 72.

According to the foregoing manner, the offset is cancelled out by applying a reverse voltage corresponding to the offset in such a manner that the capacitance C10 for offset canceling is provided on the circuit connecting the output line and the non-inverse input terminal 201 of the voltage follower circuit 72.

In the data driver of the conventional DAC method shown in FIG. 4, the capacitance C10 as the offset canceling circuit is necessarily housed in the chip. However, it requires a large area since the capacitance C10 having a sufficiently larger capacity than the input capacity of the voltage follower circuit 72. When the offset canceling capacity is too small, it is regarded as a noise in the input capacity of the voltage follower circuit 72, and thus the noise is superposed on the output voltage.

Furthermore, in order to charge the offset voltage in the offset canceling capacitance C10, a period of time of from 3 to 5 $\mu$s is generally required.

In the active matrix type of liquid crystal display of these kinds, the horizontal scanning period (select period) is necessarily set at a short period when high definition display is conducted by increasing the number of pixels in one line. For example, the select period becomes as short as from 8 to 12 $\mu$m in high definition display of SXGA.

In this case, it becomes difficult to assure a period of time for offset canceling when the period for charging the capacitance C10 for offset canceling occupies the select period.

SUMMARY OF THE INVENTION

The invention has been developed taking the problems into consideration, and an advantage thereof is to provide a voltage supplying device that can promptly and precisely provide a required charging voltage without an offset canceling circuit, and a semiconductor device, an electro-optical device and an electronic instrument using the same.

According to one aspect of the present invention, there is provided a voltage supplying device which supplies a voltage to a load capacitance to finish charging the load capacitance with a predetermined voltage within a predetermined charging period. The voltage supplying device includes a voltage supplying source, an impedance conversion circuit which performs impedance conversion for a voltage from the voltage supplying source and outputs the converted voltage, a first switching element connected between the impedance conversion circuit and the load capacitance, a bypass line for bypassing the impedance conversion circuit and the first switching element and supplying a voltage from the voltage supplying source to the load capacitance, and a second switching element provided on the bypass line.

The impedance conversion circuit may include a voltage follower circuit for outputting the voltage supplied from the voltage supplying source by a first current drive capability, and a booster provided at an output stage of the voltage follower circuit, for outputting a current to be added to an output of the voltage follower circuit by a second current drive capability. The first switching element is turned on and the second switching element is turned off in a first period of the charging period and a second period subsequent to the first period, and the first switching element is turned off and the second switching element is turned on in a third period of the charging period subsequent to the second period. Furthermore, in the first period, both the voltage follower circuit and the booster are driven so that a voltage is outputted from the impedance conversion circuit by the first current drive capability and the second current drive capability. Also, in the second period, the voltage follower circuit is driven so that a voltage is outputted from the impedance conversion circuit by the first current drive capability.

DETAILED DESCRIPTION OF THE PREFERRED EMBODIMENTS

Figure 1:
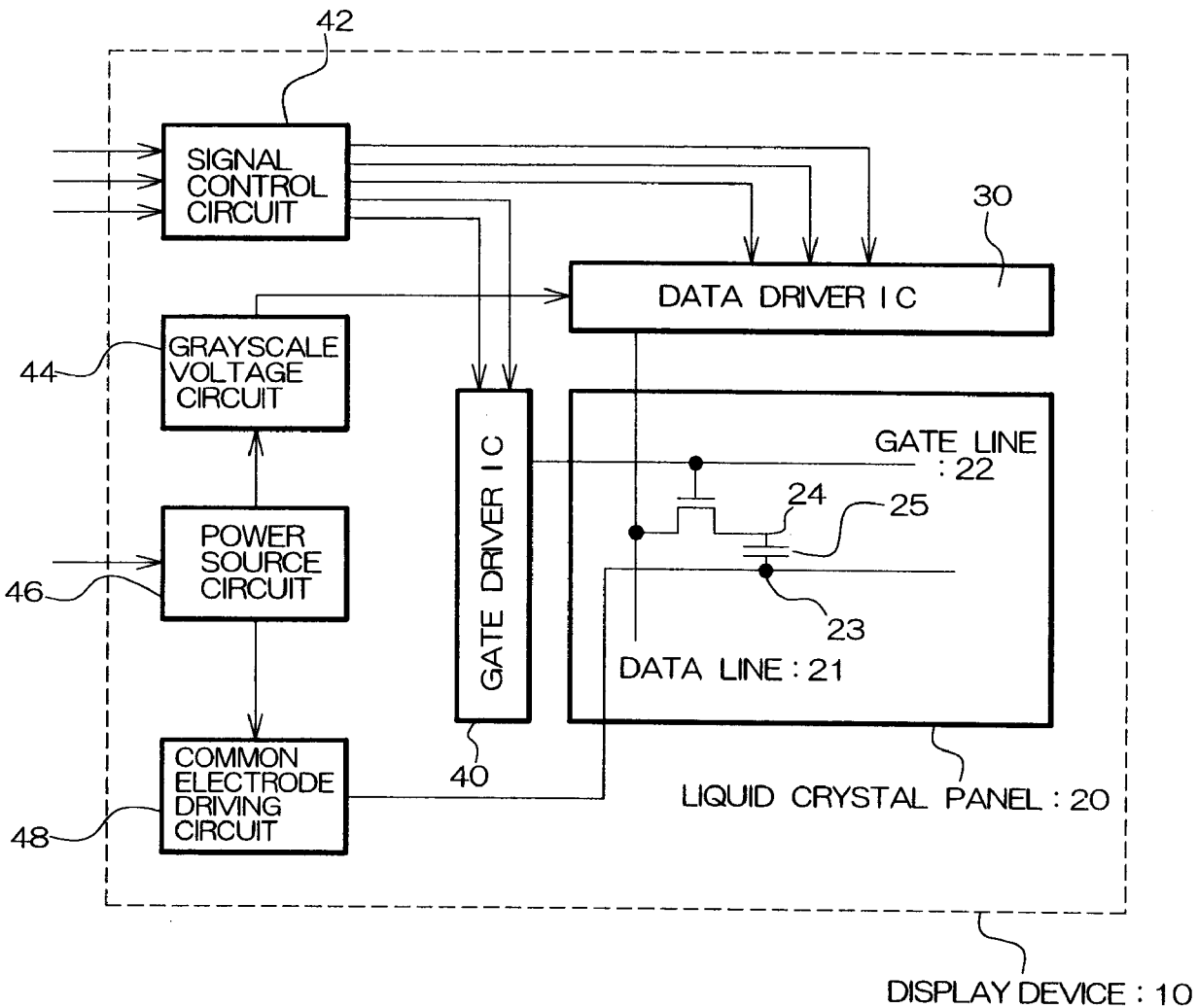
FIG. 1 is a schematic diagram showing a liquid crystal device to which the present invention is applied.

Preferred embodiments of the invention will be described below with reference to the drawings.

According to one aspect of the present invention, there is provided a voltage supplying device which supplies a voltage to a load capacitance to finish charging the load capacitance with a predetermined voltage within a predetermined charging period. The voltage supplying device includes a voltage supplying source, an impedance conversion circuit which performs impedance conversion for a voltage from the voltage supplying source and outputs the converted voltage, a first switching element connected between the impedance conversion circuit and the load capacitance, a bypass line for bypassing the impedance conversion circuit and the first switching element and supplying a voltage from the voltage supplying source to the load capacitance, and a second switching element provided on the bypass line.

The impedance conversion circuit may include a voltage follower circuit for outputting the voltage supplied from the voltage supplying source by a first current drive capability, and a booster provided at an output stage of the voltage follower circuit, for outputting a current to be added to an output of the voltage follower circuit by a second current drive capability. The first switching element is turned on and the second switching element is turned off in a first period of the charging period and a second period subsequent to the first period, and the first switching element is turned off and the second switching element is turned on in a third period of the charging period subsequent to the second period. Furthermore, in the first period, both the voltage follower circuit and the booster are driven so that a voltage is outputted from the impedance conversion circuit by the first current drive capability and the second current drive capability. Also, in the second period, the voltage follower circuit is driven so that a voltage is outputted from the impedance conversion circuit by the first current drive capability.

According to one aspect of the present invention, the output voltage from the impedance conversion circuit is supplied to the load capacitance through the first switching element in the first and second periods of the charging period. If an offset is present between the input and output voltages of the impedance conversion circuit, the load capacitance will not be charged with the predetermined voltage even when the output voltage from the impedance conversion circuit is continuously supplied to the load capacitance.

Thus, the route for voltage supplying is switched to the bypass route in the third period of the charging time, whereby the voltage from the voltage supplying source is directly supplied to the load capacitance without using the impedance conversion circuit. Accordingly, the load capacitance is supplied with a voltage compensating the shortage caused by the offset and can be charged with the predetermined voltage. The charge amount per unit period of time supplied from the voltage supplying source to the load capacitance is decreased since the impedance conversion is not performed. However, if the load capacitance has been charged with a sufficient voltage by the output voltage from the impedance conversion circuit, the load capacitance can be charged to the predetermined voltage within the charging period.

Furthermore, according to one aspect of the present invention, because a capacitance for offset canceling used in the conventional technique is not necessary, a period of time for charging the capacitance for offset canceling with an offset voltage is not necessary.

In addition, according to one aspect of the present invention, both the voltage follower circuit and the booster are operated during the first period. As a result, the current drive capability in the first period can be increased, as compared with a case in which only the voltage follower circuit is driven in the second period. As a consequence, the charging speed of the load can be increased. Accordingly, even when either the load capacitance is large or the charging time is short, the load can be charged up to a target voltage in this charging time period. Also, since the charging speed is decreased in the second period, it is possible to avoid an oscillation caused by charging up the load too quickly. Moreover, since oscillation can be prevented without providing the phase compensation capacitance in the voltage follower circuit, there is no increase in power consumption.

In accordance with one aspect of the present invention, the voltage supplying device further includes a time period length setting circuit for setting time period lengths of the first, second and third periods. This time period length setting circuit may variably change the lengths of the first, second and third periods based on information supplied from outside an IC on which the voltage supplying device is mounted. In this way, an IC containing this voltage supplying device may be commonly used in various types of electro-optical panels with different loads and the like. This makes it possible to use the IC for a wide variety of purposes.

In accordance with one aspect of the present invention, there may be a period in which both the first and second switching elements are turned off. This makes it possible to prevent positive feedback of the voltage from the voltage supplying source through the bypass line to the impedance conversion circuit.

In accordance with one aspect of the present invention, the voltage supplying device further includes a third switching element connected on a power source line which supplies a power source voltage to the impedance conversion circuit. The third switching element is turned off, synchronized with an off operation of the first switching element. This makes it possible to stop the power supply when the output from the impedance conversion circuit is unnecessary, so as to reduce power consumption.

The impedance conversion circuit may be formed of a voltage follower circuit. When an input voltage having a magnitude near a power source potential VDD or a ground potential VEE is input to the voltage follower circuit, such voltage follower circuit has a property in which an output voltage is saturated and shows no linear characteristics in response to an input voltage. In this case, a voltage from the voltage supplying source is supplied to the load capacitance through the bypass line by turning off the first switching element and turning on the second switching element in a saturated region of an output voltage of the voltage follower circuit. This makes it possible to supply a linear output voltage by directly outputting a voltage from the voltage supplying source in the saturated region in which an output voltage is saturated with respect to a lower or higher input voltage in the voltage follower circuit.

In order to generate a linear output voltage when using the above-described voltage follower circuit, the voltage supplying device further includes a comparator for comparing an output voltage from the voltage supplying source with an output voltage from the voltage follower circuit. The first and second switching elements can be controlled according to a result of comparison by the comparator, enabling to output a voltage from the voltage supplying source instead of the saturated voltage.

According to one aspect of the present invention, there is provided a semiconductor device including the above-described voltage supplying device. In the semiconductor device, a capacitance for offset canceling is unnecessary, so that the chip size can be reduced by the area of the capacitance or other elements can be integrated on the area of the capacitance to increase the degree of integration. Also, the semiconductor device may be used for a wide variety of purposes, when the semiconductor device is configured in such a way that information used to set the first to third periods may be set variably from outside.

According to one aspect of the present invention, there is provided an electro-optical device including a display section using an electro-optical element and a semiconductor device which is provided with the above-described voltage supplying device, wherein the semiconductor device is used as a driver IC for driving a signal line of the display section. A precise driving voltage can be supplied to the electro-optical element by supplying a voltage from the voltage supplying source through a signal line of the display section to the electro-optical element.

In this case, the electro-optical element may be driven based on grayscale voltages from the voltage supplying device. The voltage supplying source can be formed of a digital-analog converter which converts a digital grayscale signal to an analogue voltage. The first period of the charging period may be finished after the load capacitance is charged with a voltage which has a magnitude within a range corresponding to half of the least signification bit with respect to a desired grayscale voltage value to be supplied to the electro-optical element and which has a magnitude of 90% or more of the desired grayscale voltage value. When a sufficient voltage is supplied to the electro-optical element in the first period of the charging period, the applied voltage to the electro-optical element can reach the desired grayscale voltage even when the voltage from the DA converter is directly supplied to the load capacitance in the second period of the charging period, and furthermore, the gray level in the electro-optical element can be prevented from being differentiated.

According to one aspect of the present invention, there is provided an electronic instrument including the above described electro-optical device. Image quality can be improved by using the electro-optical device as a display of the electronic instrument First Embodiment Liquid Crystal Device FIG. 1 shows a construction diagram of the whole body of a liquid crystal device including a liquid crystal panel device and peripheral circuits thereof.

In FIG. 1, a liquid crystal panel 20 is, for example, a TFT type of liquid crystal panel.

A gate driver IC 40 (scanning line driver IC) connected to address lines (scanning lines) and a data driver IC 30 (signal line driver IC) connected to data lines (signal lines) are provided as a circuit driving the liquid crystal panel 20. The gate driver IC 40 and the data driver IC 30 are supplied with predetermined voltages from a power source circuit 46 and drive the data lines 21 and gate lines 22 based on the signals supplied from a signal control circuit 42. The data driver IC 30 and the gate driver IC 40 each is actually constituted by plural ICs. A grayscale voltage circuit 44 supplies a reference voltage necessary for driving based on grayscale voltages in the data driver IC 30. A liquid crystal capacitance 25 is formed by sealing a liquid crystal between a pixel electrode 24 and a common electrode 23. A common electrode driving circuit 48 supplies a common voltage to the common electrode 23.

The invention is not limited to a TFT type of liquid crystal panel but can be applied to other display panels using an electro-optical element including a liquid crystal.

Data Line Driving Circuit

Figure 2:
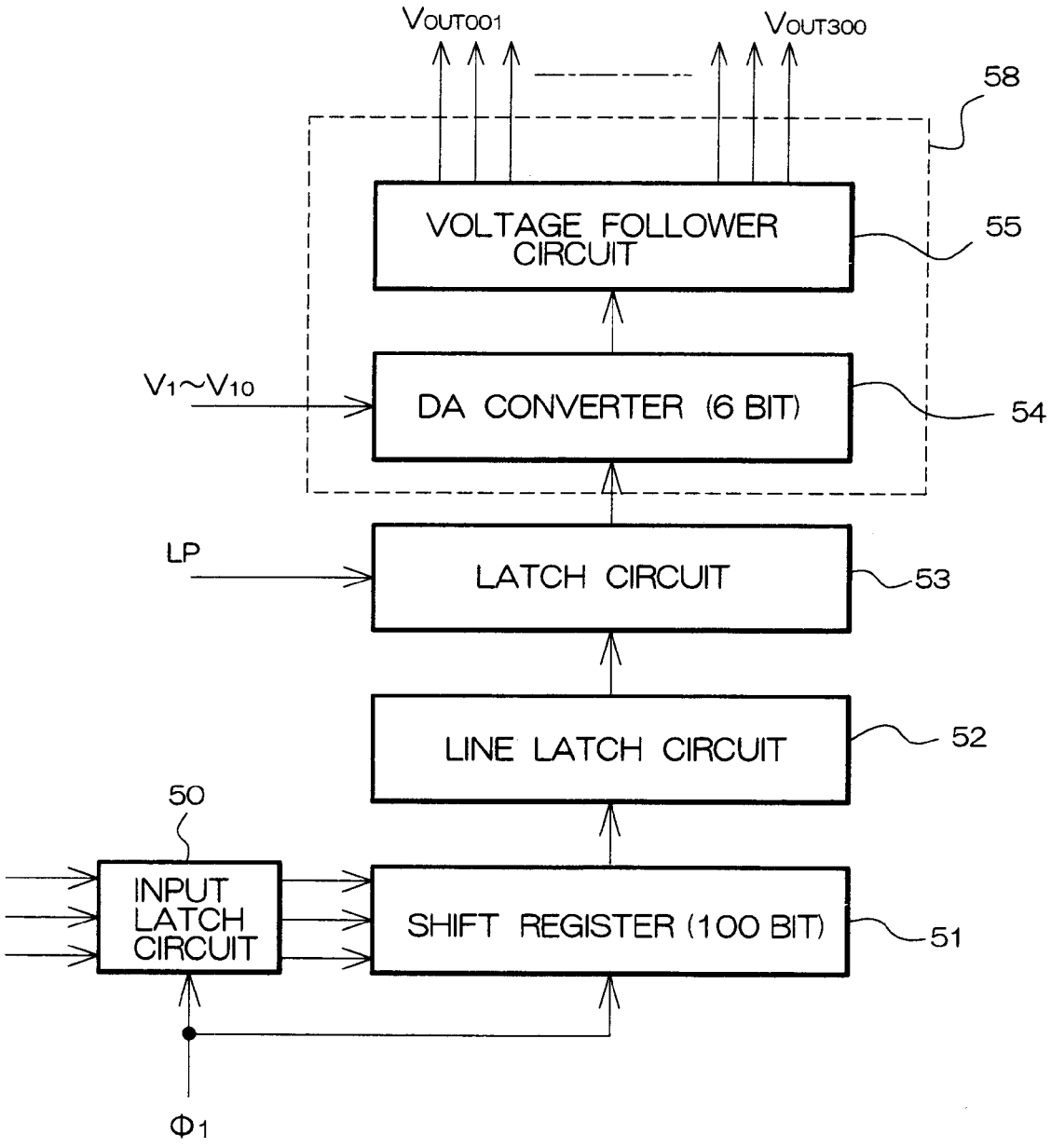
FIG. 2 PRIOR ART
FIG. 2 is a block diagram showing a conventional data driver IC.
Figure 3:
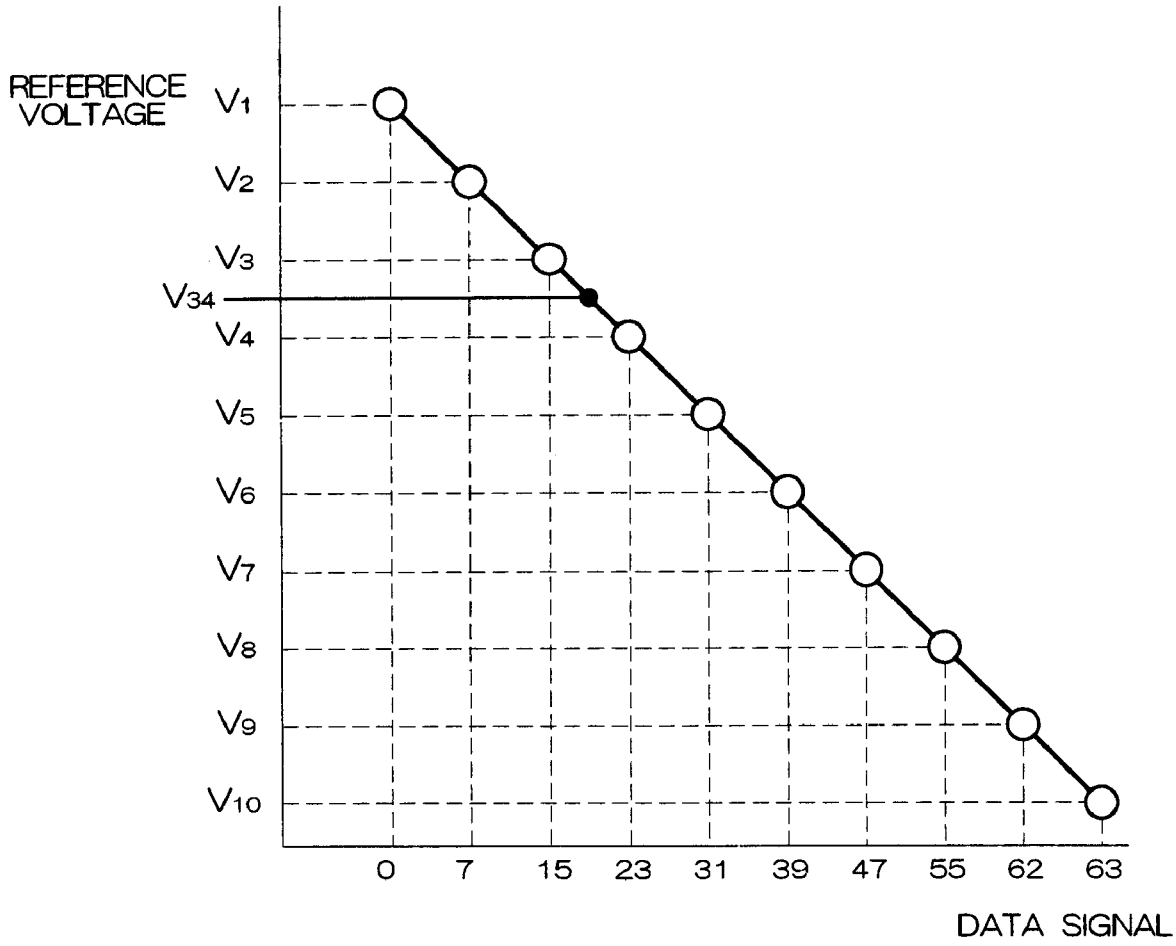
FIG. 3 PRIOR ART
FIG. 3 is a graph showing the output characteristics of the conventional data driver IC shown in FIG. 2

FIG. 2 is a constitution diagram of the data driver IC 30 for driving the liquid crystal panel 20 shown in FIG. 1, and FIG. 3 is an example of a driving wave form driving the data line 21 in the liquid crystal panel 20 shown in FIG. 1.

FIG. 2 is a internal block diagram of the data driver IC 30 for displaying three colors and 64 grayscales, for example, having 300 output lines as the data line output 21.

In the data driver IC 30, display data composed of RGB signals each having 6 bits supplied from the signal control circuit 42 is latched by an input latch circuit 50 one by one based on the timing of a clock signal ø1 similarly supplied from the signal control circuit 42. The display data corresponding to 100 clocks of the clock signal ø1 (RGB×6 bits×100 clocks) is incorporated in a line latch circuit 52 through a 100-bit shift register 51. The display data is further incorporated in a latch circuit 53 at the timing of a latch pulse LP. The display data in the latch circuit 53 is converted to an analogue signal by a 6-bit DAC 54 and further subjected to impedance conversion by a voltage follower circuit 55, whereby it is supplied to the data lines 21 of the liquid crystal panel 20.

As shown in FIG. 3, the 6-bit DAC 54 generates 64 levels of grayscale voltage, and for example, 10 levels of voltages V1 to V10 are supplied from the outside. The reference voltages V1 to V10 are supplied from the grayscale voltage circuit 44. In the DAC 54, for example, one of the voltages in the voltage range divided into 10 levels of reference voltage V1 to V10 is selected by the upper three bits of each 6 bits of RGB. For example, a reference voltage between V4 and V5 is selected. Then, V34 level, which is one of the eight voltage levels in the voltage range specified by the upper three bits, for example, the voltage range between V4 and V5, is selected by the lower three bits of the data.

Voltage Supplying Device

Figure 5:
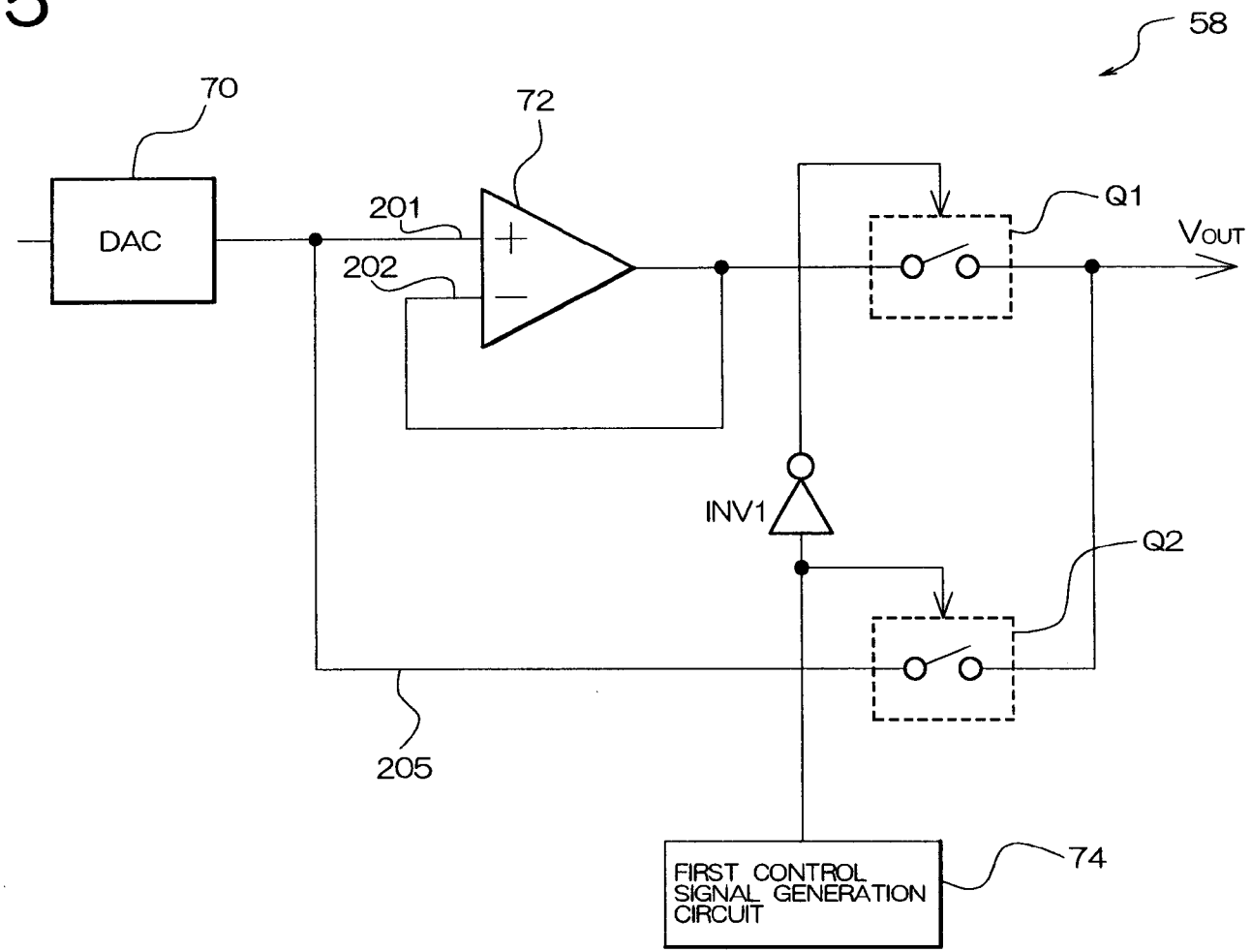
FIG. 5 is a diagram showing a voltage supplying device 1 of the first embodiment of the invention.

FIG. 5 shows a circuit diagram of a voltage supplying device 58 outputting an output of a DAC 70 to the data lines of the TFT type of liquid crystal panel through a voltage follower circuit 72.

The DAC 70 shown in FIG. 5 is connected to one data lines 21, and the DA converter 54 shown in FIG. 2 is constituted by plural DACs 70. The relationship between the voltage follower circuit 72 and the voltage follower circuit 55 is the same.

In the circuit shown in FIG. 5, the output from the DAC 70 is supplied to a non-inverse input terminal 201 of the voltage follower circuit 72, and the output of the voltage follower circuit 72 is returned and supplied to an inverse input terminal 202. A first switching element Q1 is provided on an output line between the voltage follower circuit 72 and a load capacitance (a wiring capacitance of the data lines 21 or the liquid crystal capacitance 25). A second switching element Q2 is provided on a bypass line 205 supplying the voltage from the DAC 70 to the load capacitance bypassing the voltage follower circuit 72 and the first switching element Q1.

A control signal from a first control signal generation circuit 74 is supplied to the second switching element Q2 for on-off control. An inverter INV1 is connected to the first switching element Q1 to supply an inverse signal of the output from the first control signal generation circuit 74, so as to subject the first switching element Q1 to on-off control. The control signal is, for example, a signal CNT1 output based on the timing synchronized with the latch pulse LP of the data shown in FIG. 6B described later.

Figure 6A:
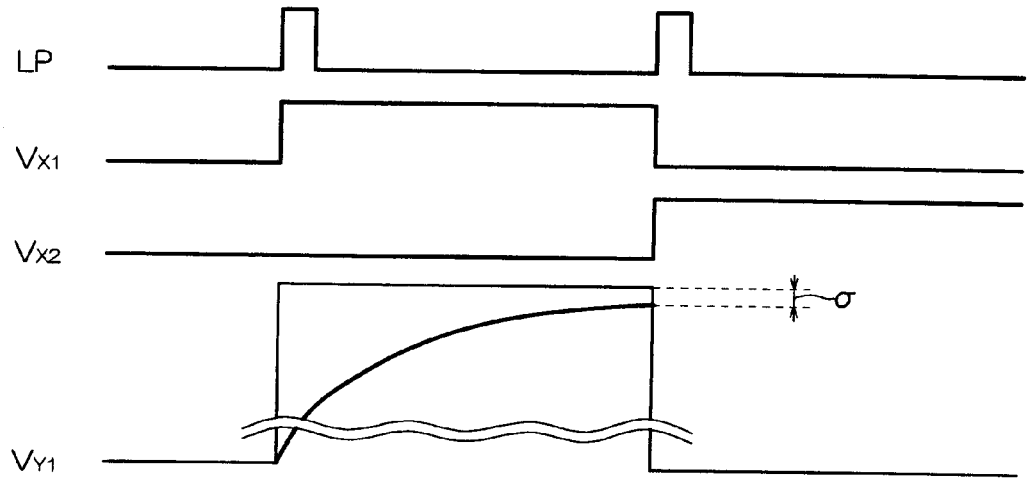
FIG. 6A is a waveform chart showing operations of the voltage supplying device of FIG. 4.

FIG. 6A shows wave forms of the latch pulse LP, the supplied voltages VX1 and VX 2 to the gate lines, and an output voltage to the data lines. Within the period of one flame, the voltage wave form charged in the liquid crystal capacitance 25 through the data line 21 in the select period of the gate line 22 is shown by VY1.

A voltage applied to the data lines 21 is demanded to have high accuracy with the increase in the number of grayscales and colors of the current liquid crystal panels. But conventionally, a potential output through the voltage follower circuit does not reach the necessary grayscale potential due to dispersion of the input and output voltages caused by offset, so that it is often difficult to set the grayscale potential in a highly accurate manner.

Figure 4:
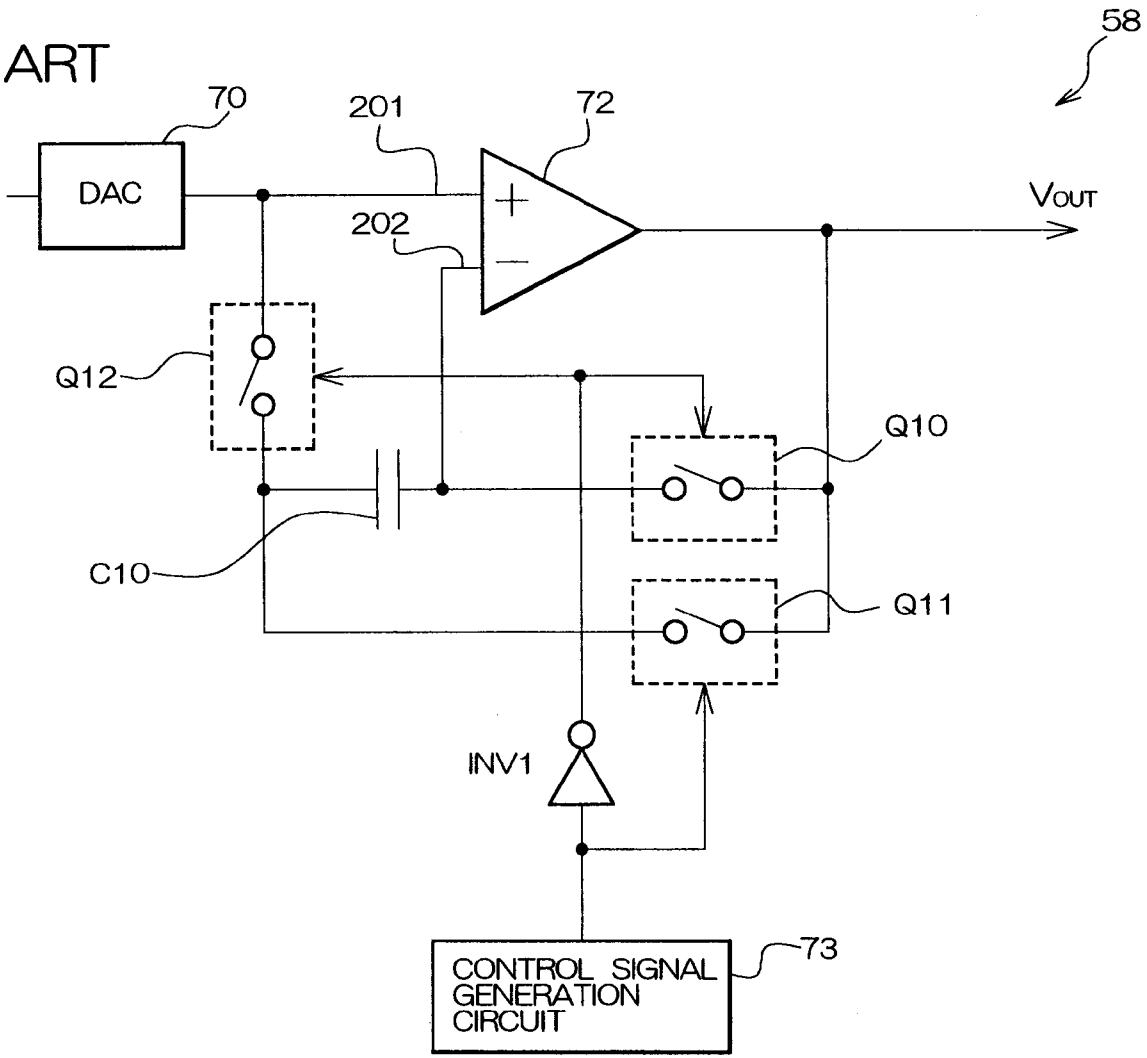
FIG. 4 PRIOR ART
FIG. 4 is a diagram showing an example of a voltage supplying device using a conventional voltage follower circuit shown in FIG. 2.

That is, as shown in FIG. 6A, it does not reach the grayscale potential within the select period t, and the potential short by δ is charged in the liquid crystal capacitance 25. The variation of the input and the output caused by the offset can be compensated by providing the offset canceling circuit as shown in FIG. 4, but it brings about such problems that the area of the capacitance C10 therefor is increased, and the speed of attaining the necessary grayscale potential is insufficient.

According to the embodiment, taking the limitation in output performance of the voltage follower circuit into consideration, switching is conducted, at a time when the grayscale potential output can be maintained to a certain extent, in such a manner that the output from the DAC 70 is supplied to the liquid crystal capacitance 25 instead of the output of the voltage follower circuit.

Figure 6B:
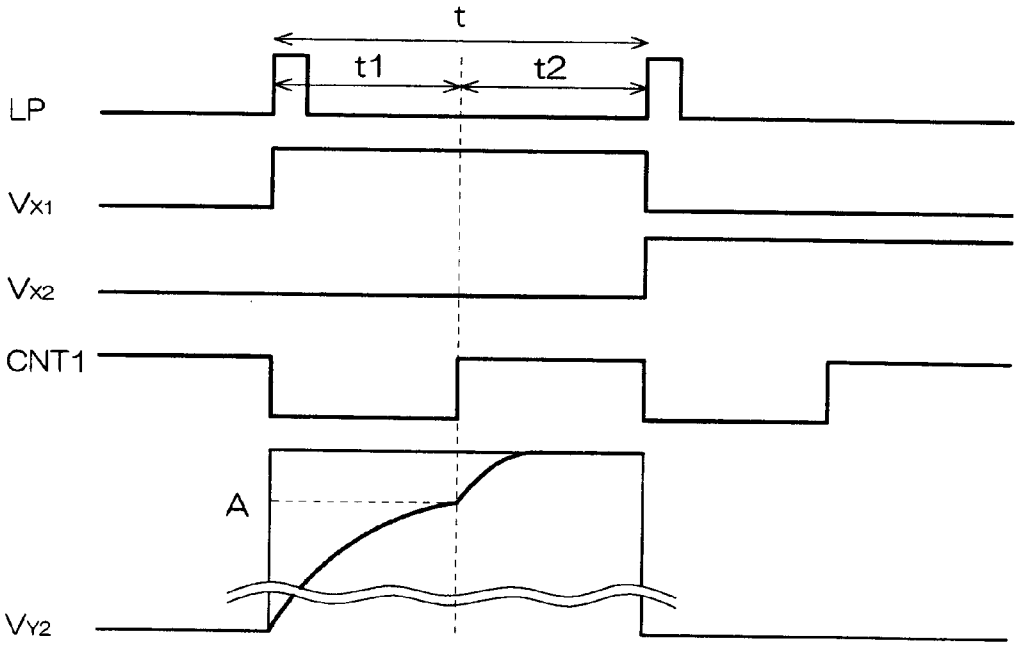
FIG. 6B is a waveform chart showing operations of the voltage supplying device of FIG. 5.

In FIG. 6B, operation of the data driver of the TFT type of liquid crystal panel device relating to the embodiment will be described below with reference to FIG. 5.

While varying depending on the specifications, it takes about a half of the select period to amplify the output of the voltage follower circuit 72 by the DAC method of the TFT type of liquid crystal device to 99% or more of the necessary voltage value. For example, in the case of the liquid crystal driver requiring 12 V, the charge amount Q=12×C (C represents a load capacitance) is necessarily charged by the output of the voltage follower circuit 72. When the difference between the input voltage and the output voltage at the end of the first period of the select period reaches 10 mV, the load capacitance (charge amount) that should be charged in the second period of the select period is Q=0.01×C. As a result, in the case of switching to the output of the DAC 70, the necessary grayscale voltage can be obtained by supplying a charge amount of 1/1,200 (about 0.1%) of the necessary charge amount Q. While the select period t varies depending on the panels, it is generally about from 8 to 12 $\mu$s for high definition display of SXGA.

A voltage VX1 is applied to one of the gate lines 21 by the gate driver IC40 over the select period t between the latch pulses LP, so as to turn the transistor on. According the procedure, the liquid crystal capacitance 25 in the liquid crystal panel 20 falls in the chargeable state. In the data driver IC30, the first switching element Q1 is turned on, and the second switching element Q2 is turned off by the control signal CNT1 output in synchronized with the latch pulses LP. Thus, a voltage VY2 is output from the voltage follower circuit 72 to the data lines 21. The voltage VY2 is charged in the liquid crystal capacitance 25 through the data lines 21, and the charge in the liquid crystal capacitance 25 shows such change in lapse of time that it reaches, for example, the point A exceeding 99% of the necessary voltage within the first period t1.

In the second period t2, the first switching element Q1 is turned off, and the second switching element Q2 is turned on, whereby the output of the voltage follower circuit 72 is cut off, so as to directly charge the output of the DAC 70 in the liquid crystal capacitance 25 through the data lines 21. In the DAC 70 at this time, while the charge amount that can be supplied per unit period of time is small, the active load influencing the output voltage is small, and the charge of the liquid crystal capacitance 25 is substantially completed, whereby the sufficient voltage can be charged in the liquid crystal capacitance 25 within the select period t.

In the case where, for example 10 mV is generated as the offset between the input and the output of the voltage follower circuit 72, switching is necessarily conducted before the necessary grayscale voltage by 10 mV. While depending on the design of the proportion between the electric current driving performances of the voltage follower circuit 72 and the DAC 70, it is appropriate to set the switching time at the time when the point A in FIG. 6B reaches 99% of the necessary voltage when the proportion is 1/100.

As described in the foregoing, in the first period t1 of the select period t, a larger charge amount per unit period of time is supplied by the output of the voltage follower circuit 72 to charge the liquid crystal capacitance 25 to a voltage of certain level. In the second period t2 of the select period t, the output of the DAC 70 is directly supplied to the liquid crystal capacitance 25, whereby a highly accurate output voltage can be rapidly obtained without necessity of the offset canceling circuit.

Operation relating to the timing of switching the output of the voltage follower circuit 72 and the output of the DAC 70 will be described with reference to FIG. 7 in the case where 90% or more of the necessary grayscale voltage is charged in the liquid crystal capacitance 25, and the voltage difference from the necessary voltage is set within the voltage range of ½ LSB (least significant bit).

Figure 7:
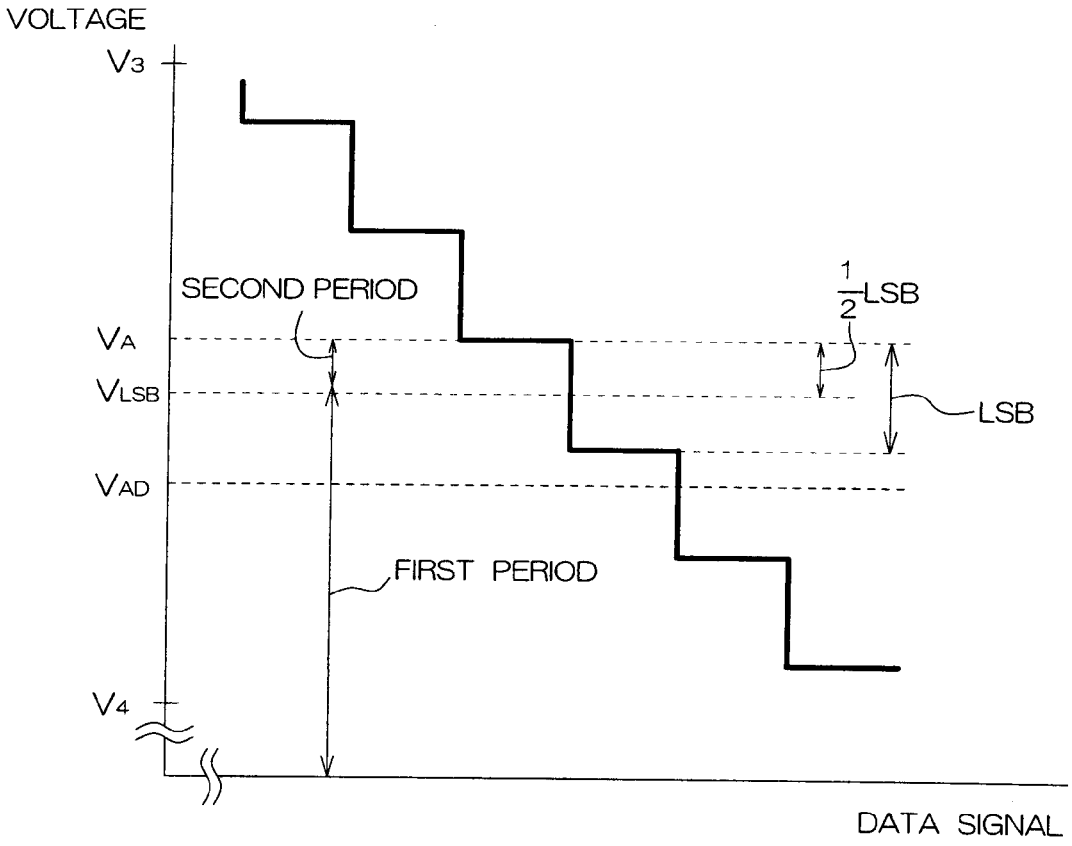
FIG. 7 is a graph showing a relationship between the voltages charged in the liquid crystal capacitance in the first and second periods of the select period.

FIG. 7 is an enlarged diagram of the wave form of the voltage applied to a liquid crystal shown in FIG. 3 between the reference voltages V3 and V4.

In order to obtain desired display of the liquid crystal, it is assumed, for example, that a voltage VA is necessary as the voltage applied to a liquid crystal. In the embodiment, it is necessary to obtain such a voltage as the voltage applied to a liquid crystal that falls in the range of the voltage VLSB corresponding to ½ LSB with respect to the necessary voltage VA (i.e., the range of from voltage VLSB to VA), and is 90% or more of the voltage VA. FIG. 7 shows an example satisfying the voltage in VAD corresponding to 90% of the necessary voltage VA, where the voltage VLSB within the range of the voltage (LSB)/2 with respect to the voltage VA is charged within the first period t1, and it is charged to the voltage VA within the second period t2.

According the configuration, the necessary liquid crystal display is ensured, and the shortage in voltage is compensated by the output of DAC 70 to obtain a highly accurate output voltage within the select period t.

With respect to the switching timing of switching the output of the voltage follower 72 and the output of the voltage output source 70, it is considered that the point, at which the grayscale voltage is ensured to a certain extent, is set as the switching timing.

Second Embodiment

Figure 8:
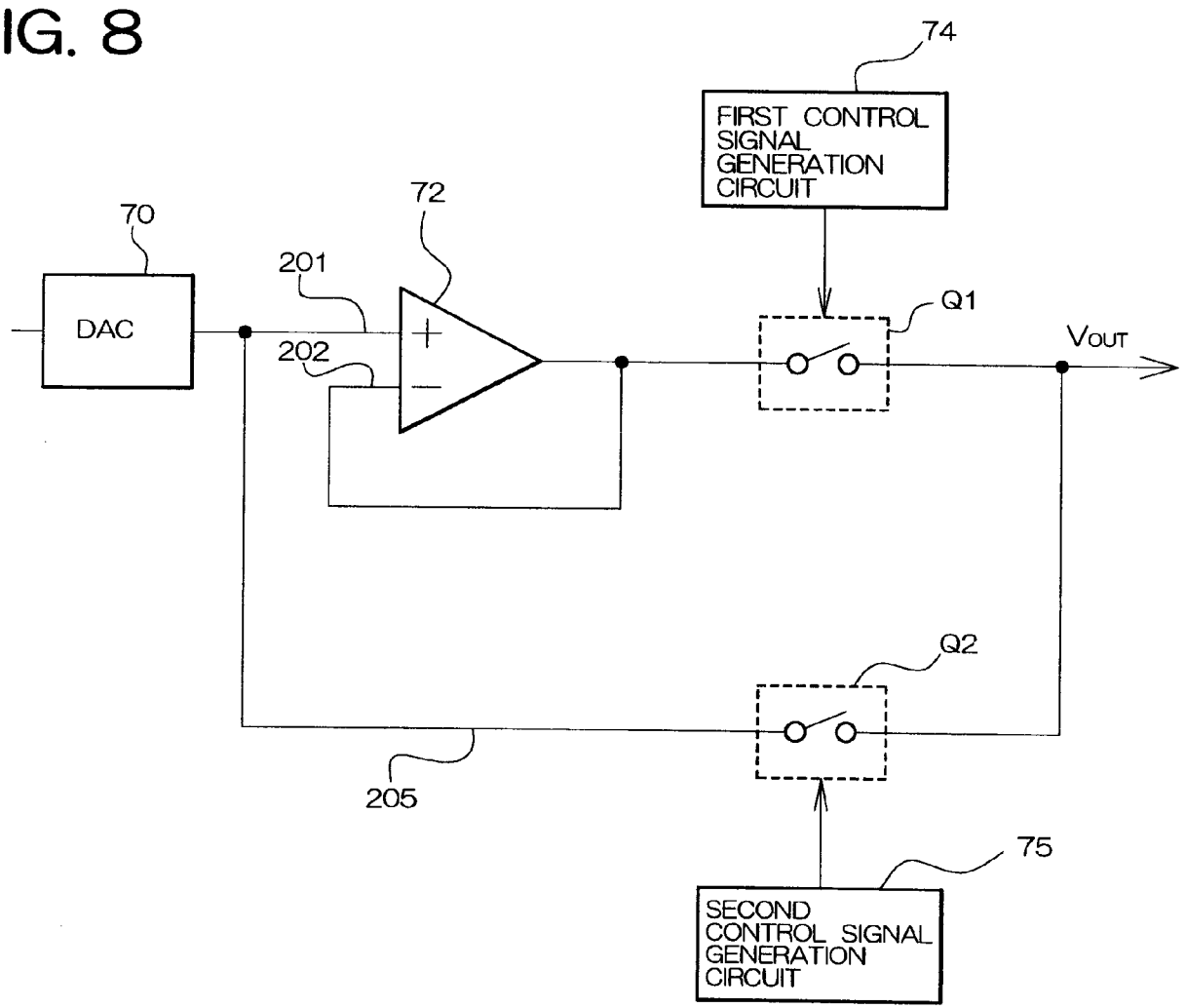
FIG. 8 is a diagram showing a voltage supplying device of the second embodiment of the invention.

FIG. 8 shows a modified example of the voltage supplying device having the constitution shown in FIG. 5.

As shown in FIG. 8, the voltage supplying device has such a constitution that a first control signal generation circuit 74 for controlling a first switching element Q1 and a second control signal generation circuit 75 for controlling a second switching element Q2, and the first switching element Q1 and the second switching element Q2 are independently controlled.

Figure 9:
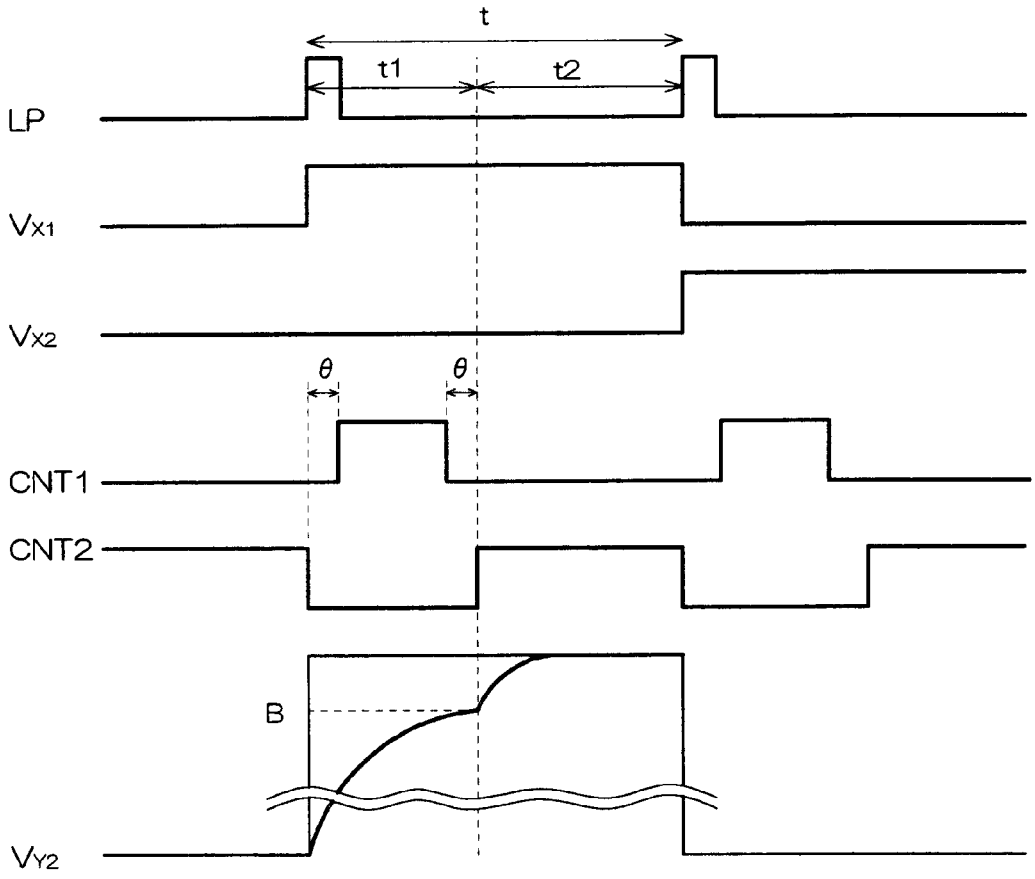
FIG. 9 is a waveform chart showing operations of the voltage supplying device of FIG. 8.

FIG. 9 shows the wave form of the embodiment shown in FIG. 8.

In FIG. 9, the first switching element Q1 is turned on by a control signal CNT1 output from a data driver IC 30 in synchronized with the latch pulses LP, and the second switching element Q2 is turned off by a control signal CNT2. At this time, the control signal CNT2 is controlled in such a manner that periods θ are present where both the first switching element Q1 and the second switching element Q2 are off.

The output of the voltage follower 72 is switched to the output of the DAC 70 by the control signals CNT1 and CNT2, so as to exhibit the wave form of the voltage applied to a liquid crystal shown by output VY2.

According to the constitution shown in FIG. 8, the first switching element Q1 and the second switching element Q2 are prevented from turning on at the same time. Furthermore, according to the constitution, such a phenomenon can be prevented from occurring that the output of the voltage follower circuit 72 is returned to the non-inverse input terminal 201 of the voltage follower circuit 72 through the second switching element Q2 to cause oscillation.

Third Embodiment

Figure 10:
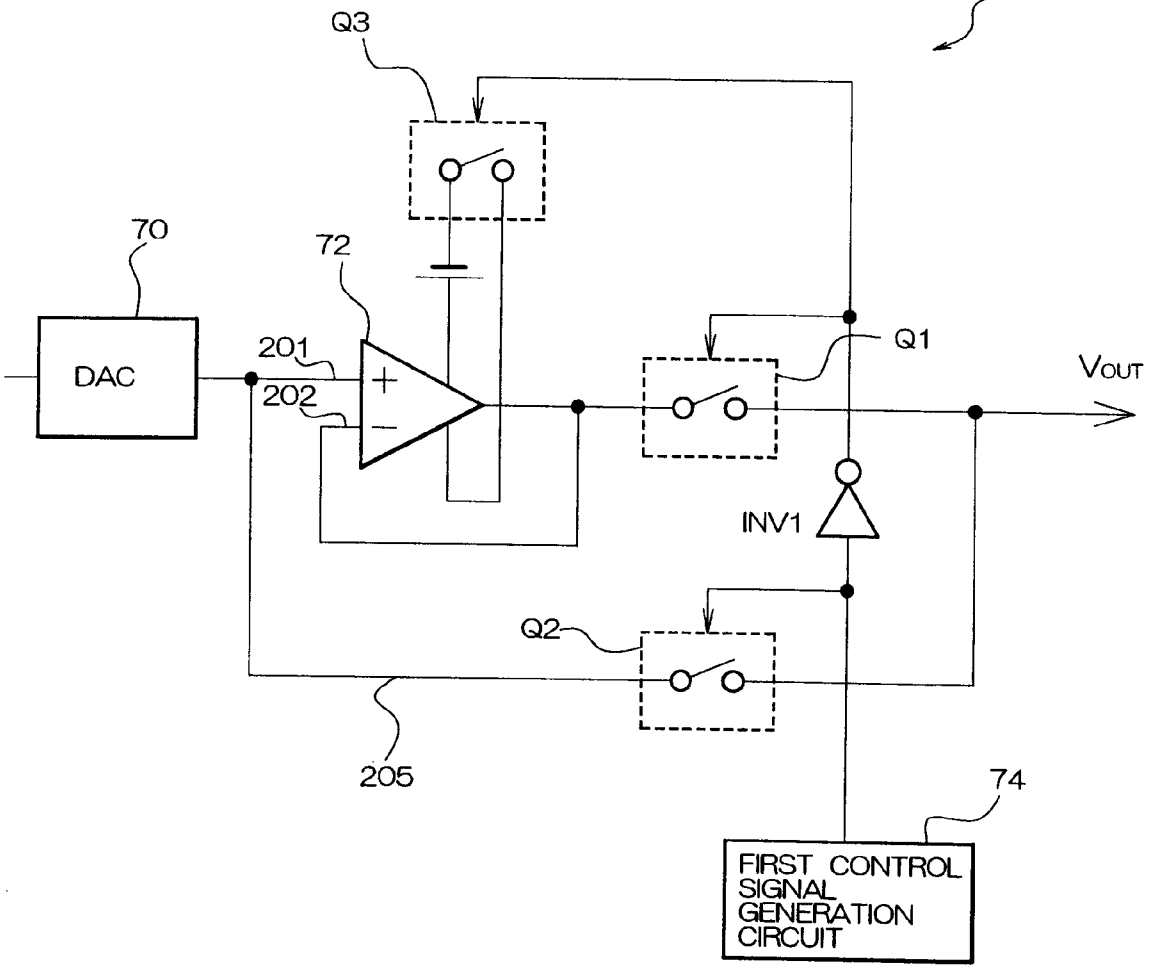
FIG. 10 is a diagram showing a voltage supplying device of the third embodiment of the invention.

In the circuit shown in FIG. 10, a third switching element Q3 is provided between the power source terminals of the voltage follower circuit 72, in addition to the circuit shown in FIG. 5. The third switching element Q3 is controlled by the control signal CNT1 in synchronized with the first switching element Q1. The operation of the DAC 70 and the voltage follower circuit 72 is the same as the circuit shown in FIG. 5.

When the output of the voltage follower circuit 72 is switched to the output of the DAC 70, the first switching element Q1 is turned off to cut off the output of the voltage follower circuit 72. The third switching element Q3 is then turned off in synchronized with the timing of turning the first switching element Q1 off, so as to cut off the power source supply to the voltage follower circuit 72.

According to the configuration, the power source supply is cut off in the period where the output of the voltage follower circuit 72 is not utilized, whereby the electric power consumption can be reduced.

Fourth Embodiment

Figure 12:
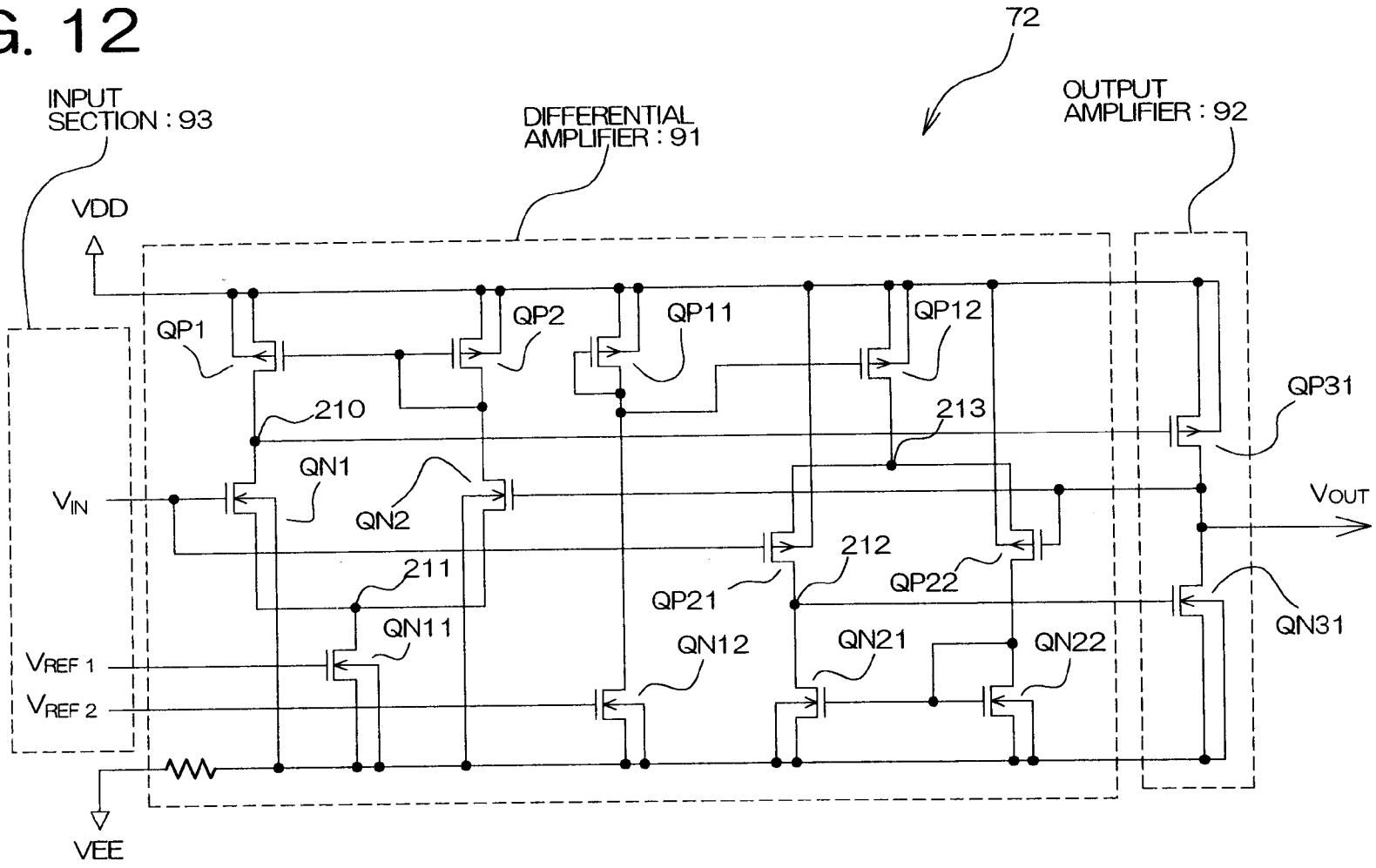
FIG. 12 is a circuit diagram of the voltage follower circuit having the characteristics shown in FIG. 11.

Examples of the constitution of the voltage follower circuit 72 include the circuit shown in FIG. 12. The circuit shown in FIG. 12 indicates a circuit of a voltage follower circuit 72 conducting class AB operational amplification, which is mainly composed of a differential amplifier 91, an output amplifier 92 and an input section 93. The circuit of FIG. 12 is constituted by N type MOS transistors QN1 to QN31 and P type MOS transistors QP1 to QP31. The voltage supplied from the DAC 70 is input as an input voltage VIN of the input section 93. Amplification in the final stage is conducted in the output amplifier 92 to supply an output voltage VOUT to the load capacitance.

Figure 11:
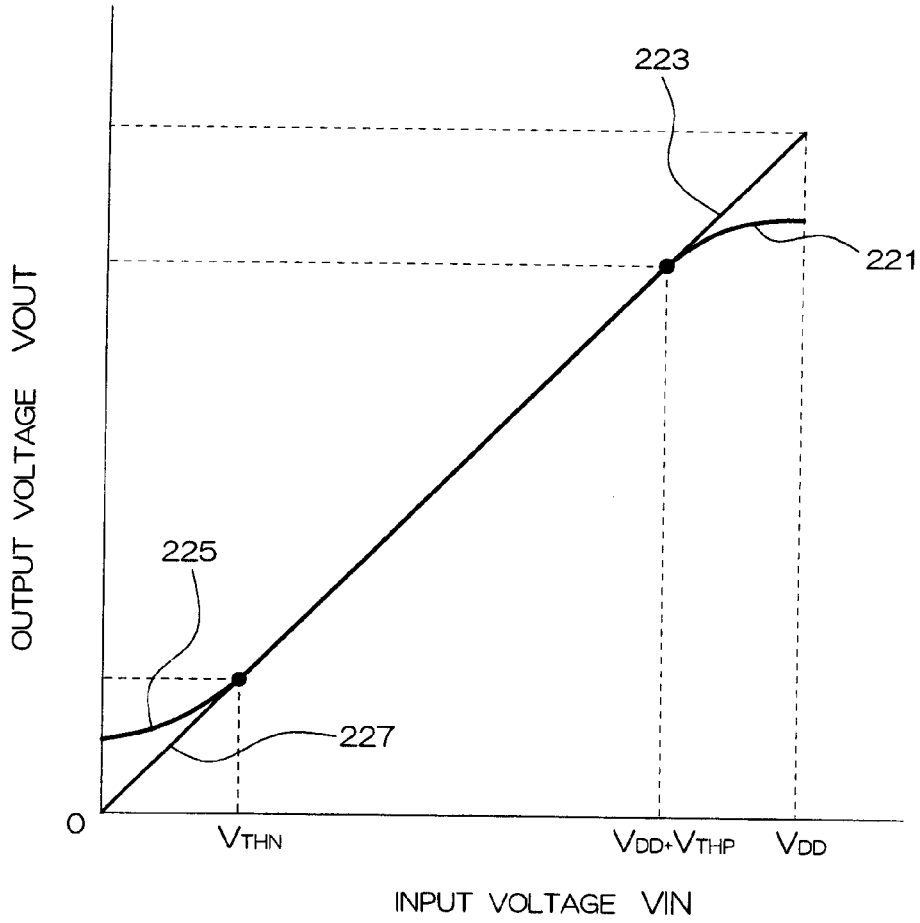
FIG. 11 is a graph showing the input and output characteristics of the voltage follower circuit used in the fourth embodiment of the invention.

The input and output characteristics of the output voltage VOUT with respect to the input voltage VIN of the voltage follower circuit 72 is shown in FIG. 11.

In the figure, VDD denotes the power source potential of the voltage follower circuit 72, and VEE denotes the ground potential.

In FIG. 11, linear input and output characteristics 227 cannot be obtained within the range of the input voltage VIN of from 0 to VTHN due to the operation of the N type MOS transistor QN31 having the threshold voltage VTHN in the output amplifier 92 in FIG. 12, but saturated output characteristics 225 appears. Similarly, linear input and output characteristics 223 cannot be obtained within the range of the input voltage VIN of from (VDD+VTHP) to VDD due to the operation of the P type MOS transistor QP31 having the threshold voltage VTHP (negative voltage) in the output amplifier, but saturated output voltage 221 appears.

In FIG. 12, when the input voltage VIN varies from 0 V to the threshold voltage VTHN, the potential of a node 212 as a drain of the P type MOS transistor QP21 connected to a gate of the N type MOS transistor QN31 in the output amplifier 92 becomes lower than the potential of a node 213 as a source. As a result, the N type MOS transistor QN31 functions to turn off in the region lower than the threshold voltage VTHN, and the electric current cannot flow. Therefore, the output voltage VOUT is saturated.

When the input voltage VIN varies from (VDD+VTHP) to the power source potential VDD, the potential of a node 210 as a drain of the N type MOS transistor QN1 connected to a gate of the P type MOS transistor QP31 in the output amplifier 92 becomes higher than the potential of a node 211 as a source. As a result, the P type MOS transistor QP31 functions to turn off in the region higher than the threshold voltage (VDD+VTIP), and the electric current cannot flow. Therefore, the output voltage VOUT is saturated.

Figure 13:
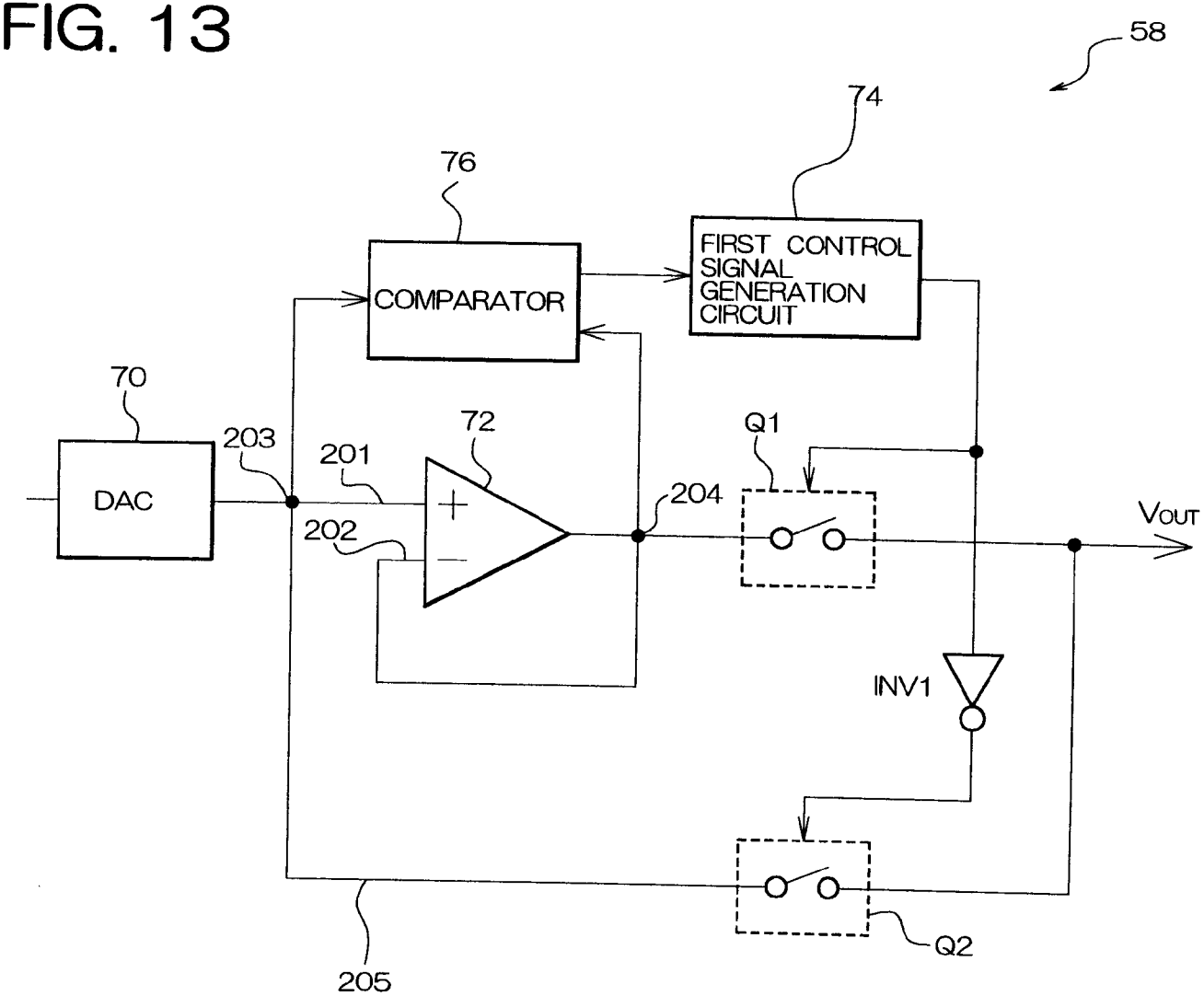
FIG. 13 is a diagram showing a voltage supplying device of the fourth embodiment of the invention containing the voltage follower circuit shown in FIG. 12.

A circuit improved in the input and output characteristics in that the output voltage is saturated due to the threshold voltages VTHN and VTHP is shown FIG. 13.

The threshold voltages VTHN and VTHP varies under the influence of a constant current circuit inside the voltage follower circuit 72, in addition to the threshold voltages inherent in the MOS transistor elements. Because a constant electric current flows by N type MOS transistors QN11 and QN12 and P type MOS transistors QP11 and QP12, the voltage corresponding to the offset is superposed. Therefore, in the embodiment, such threshold voltages VTHN and VTHP are assumed that consider the voltage corresponding to the offset.

In the circuit shown in FIG. 13, a comparator 76 is added to compare the input voltage at the node 203 and the output voltage at node 204 of the voltage follower circuit 72. Based on the compared result of the comparator 76, a control signal is supplied to the gates of the first switching element Q1 and the second switching element Q2 through the first control signal generation circuit 74.

The comparator 76 compares as to whether the output voltage VOUT at the node 204 falls within the input voltage range (VIN±ΔV) (ΔV: arbitrarily set value of error) at the node 203. The control signal is generated through the first control signal generation circuit 74. According to the operation, the first switching element Q1 is turned off, and the second switching element Q2 is turned on, whereby the output of the DAC 70 becomes the output voltage VOUT. There are cases where the output voltage VOUT is overshot or undershot with respect to the input voltage VIN to exceed or underrun the allowable range of the set value of error ±ΔV. In these cases, the allowable range considering the same (VIN±ΔV) is set, or in alternative, the gain of the output voltage VOUT is set at a large value, and the number of occurrence where the output voltage VOUT crosses a constant voltage is counted, whereby the timing of generating the control signal can be set.

Figure 14:
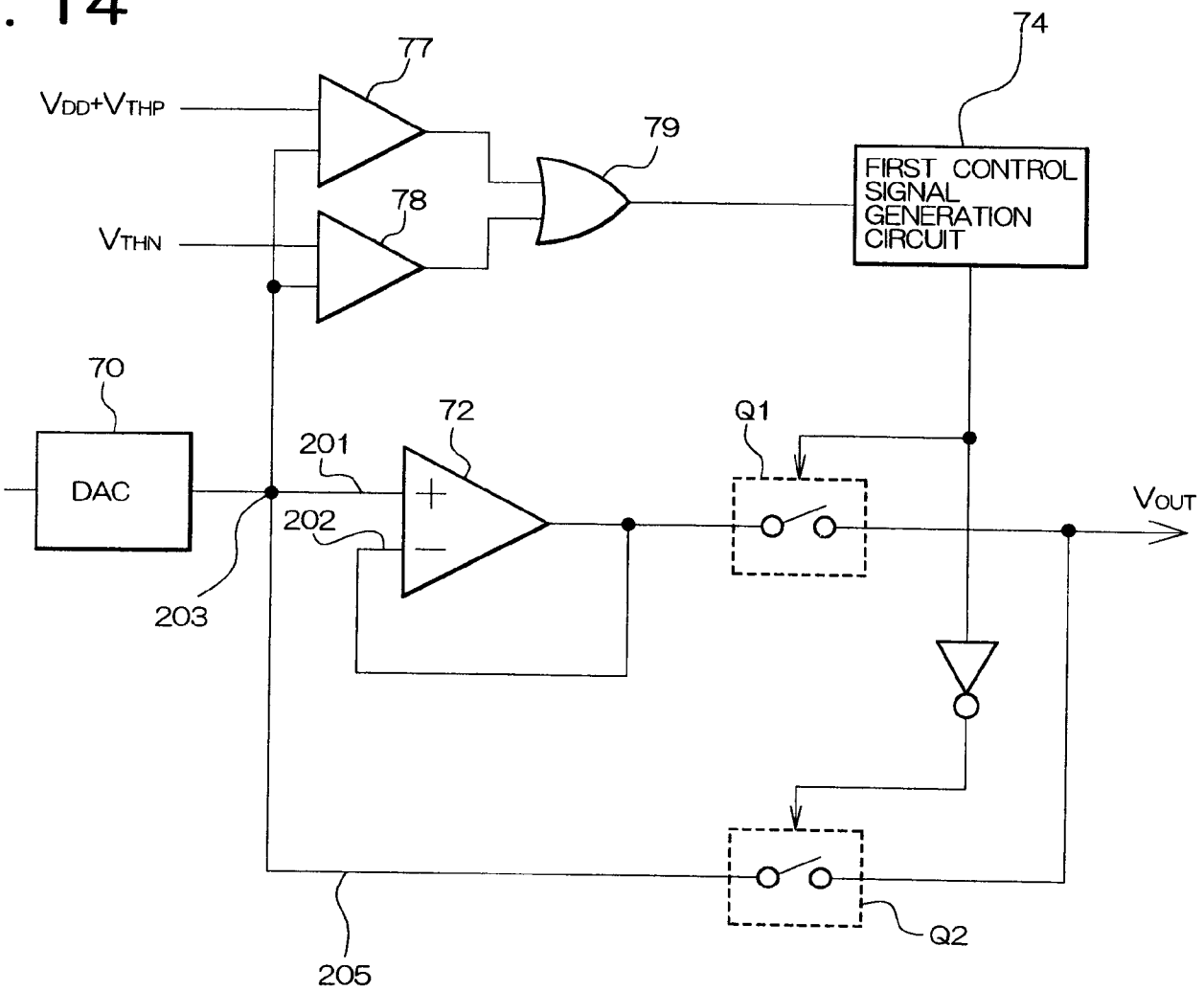
FIG. 14 is a diagram showing a modified example of the voltage supplying device shown in FIG. 13.

As a modified example of the embodiment, the method of detection shown in FIG. 14 can be considered.

The voltage supplying device shown in FIG. 14 is constituted by a first comparator 77, a second comparator 78 and an OR circuit 79 contained therein. The input voltage VIN of the voltage follower circuit 72 is compared between the voltage at the node 203 and the reference voltages set in the first comparator 77 and the second comparator 78 to provide a comparison signal, which is then supplied to the OR circuit 79. The OR circuit 79 supplies the control signal to the first switching element Q1 and the second switching element Q2 through the first control signal generation circuit 74 when at least one of the first comparator 77 and the second comparator 78 receives a high level signal.

For example, as the reference voltage of the first comparator 77, an interface point is set where the input voltage VIN at the node 203 becomes the threshold voltage (VDD+VTHP) in the input and output characteristics of the voltage follower circuit 72 shown in FIG. 11. When a voltage higher than the threshold voltage (VDD+VTHP) is input, a high level signal is output from the first comparator 77 and supplied to the OR circuit 79. A low level signal is output from the second comparator 78 and supplied to the OR circuit 79. A high level signal is thus output from the OR circuit 79 to generate the control signal through the first control signal generation circuit 74. The first switching element Q1 is turned off, and the second switching element Q2 is turned on, whereby the output of the DAC 70 becomes the output voltage VOUT. Similarly, as the reference voltage of the second comparator 78, an interface point is set where the input voltage VIN at the node 203 becomes the threshold voltage VTHN in the input and output characteristics of the voltage follower circuit 72 shown in FIG. 11. When a voltage lower than the threshold voltage VTHN is input, a high level signal is output from the second comparator 78, and a low level signal is output from the first comparator 77. A high level signal is output from the OR circuit 79 to generate the control signal through the first control signal generation circuit 74. The first switching element Q1 is turned off, and the second switching element Q2 is turned on, whereby the output of the DAC 70 becomes the output voltage VOUT.

According to the operation, when the output of the comparator 76 is varied in the range of the input voltage of from 0 to VTHN or from (VDD+VTHP) to VDD to cut off the output of the voltage follower circuit 72 at that timing, so as to switch to the output of the DAC 70, the linear output characteristics 223 can be ensured instead of the output characteristics 221 where the output voltage is saturated, or the linear output characteristics 227 can be ensured instead of the output characteristics 225.

In the case where the voltage supplying device 58 is used in a TFT liquid crystal device using the DAC method, an output voltage with high accuracy can be obtained without an offset canceling circuit. Furthermore, an output voltage with high accuracy can be obtained in the range of the input voltage from 0 V to the power source voltage VDD, and thus a voltage of a wider range can be utilized.

Fifth Embodiment

Figure 15:
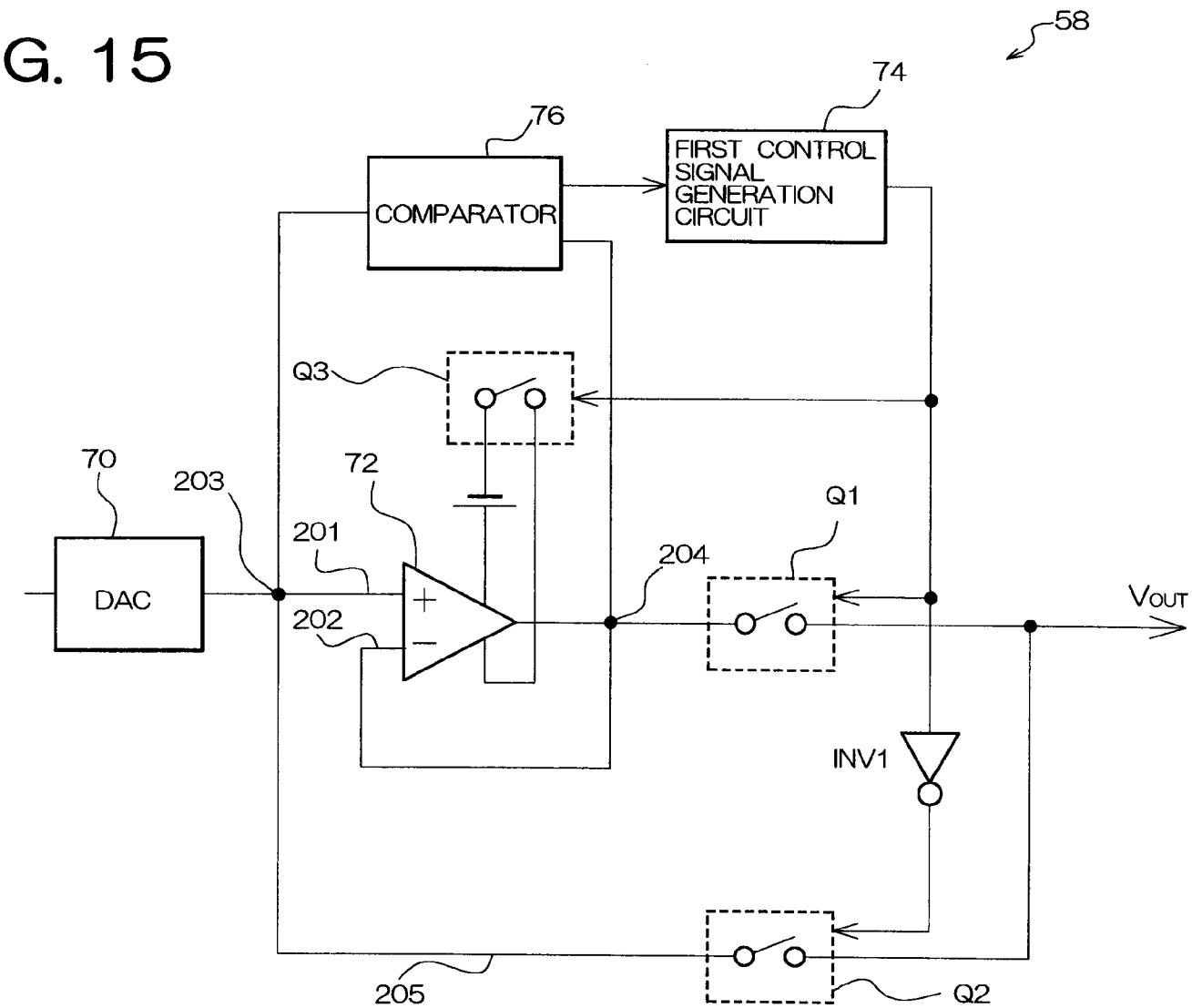
FIG. 15 is a diagram showing a voltage supplying device of the fifth embodiment of the invention.

FIG. 15 shows a circuit containing a third switching element for turning the power source voltage of the voltage follower circuit 72 on and off, in addition to a voltage supplying device having the constitution shown in FIG. 13.

As shown in FIG. 15, the power source of the voltage follower circuit 72 itself can be turned off during the period where the output of the DAC 70 is supplied as the output voltage, whereby the electric power consumption can be reduced.

Sixth Embodiment

Figure 16:
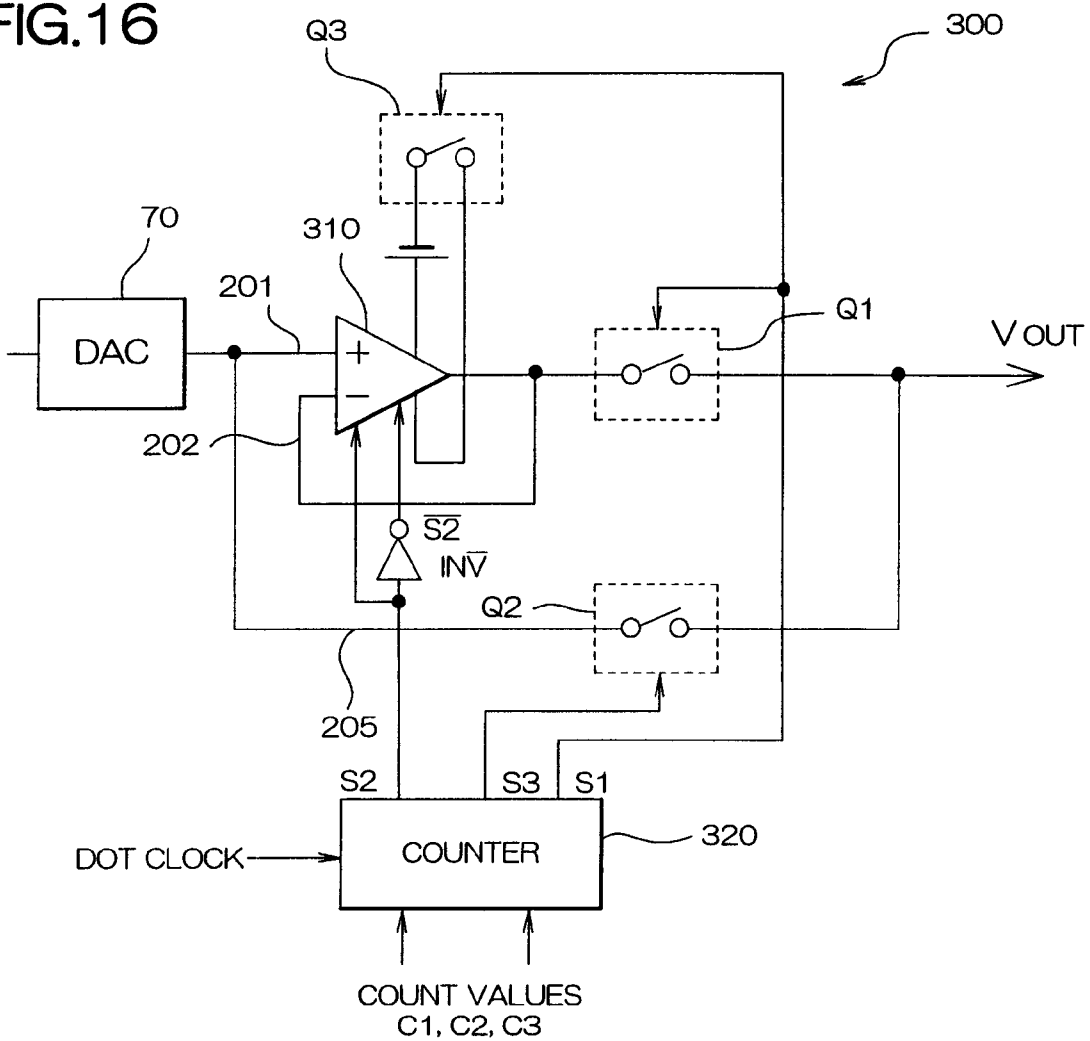
FIG. 16 is a diagram showing a voltage supplying device according to a sixth embodiment of the invention.

FIG. 16 is a schematic block diagram showing a voltage supplying circuit 300 including an impedance conversion circuit 310 equipped with a booster, in place of the voltage follower circuit 72 shown in FIG. 10.

Figure 17:
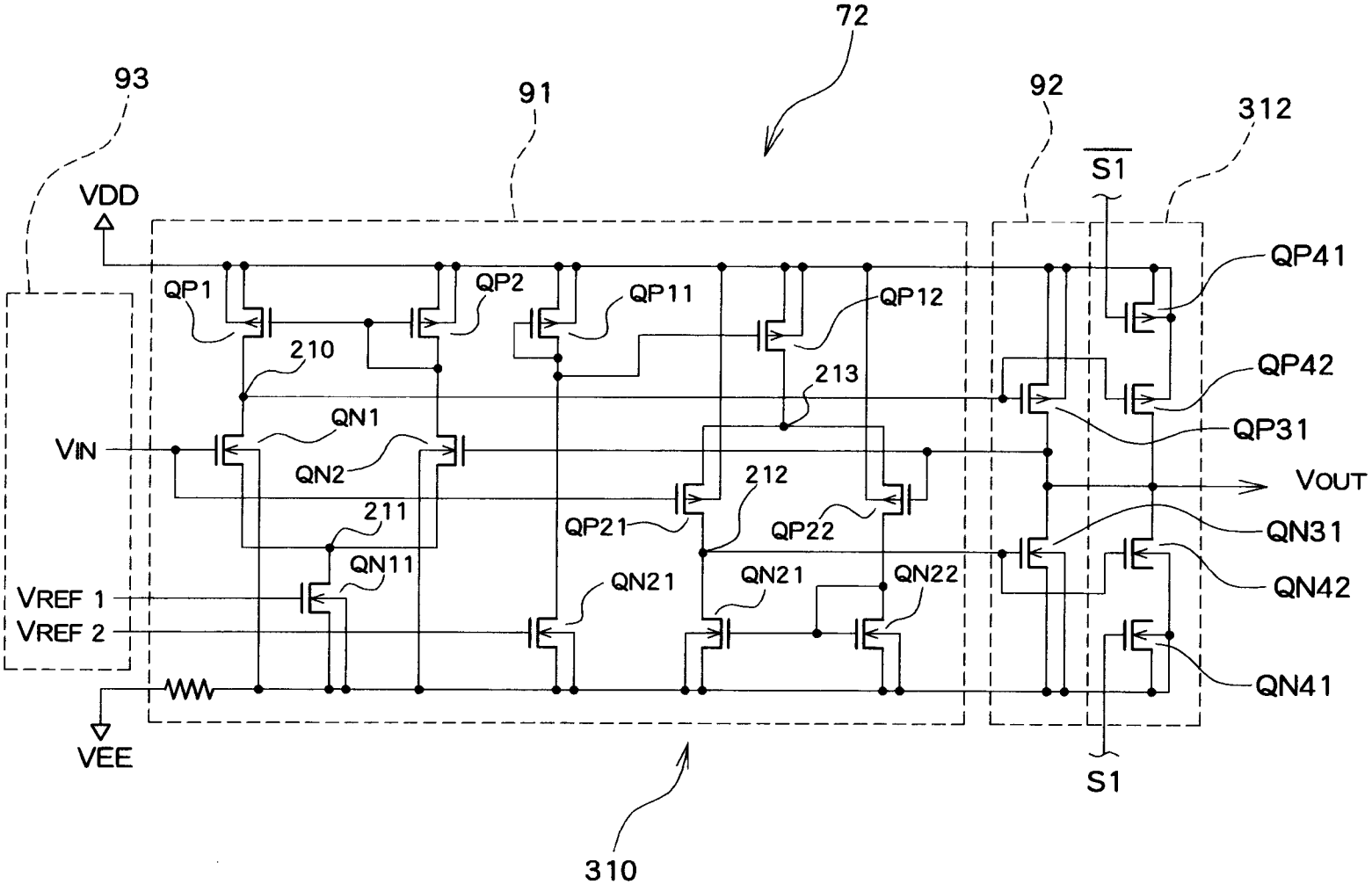
FIG. 17 is a circuit diagram showing an impedance conversion circuit equipped with a booster shown in FIG. 16.

FIG. 17 shows an example of the above-explained impedance conversion circuit 310 equipped with the booster shown in FIG. 16. In FIG. 17, the impedance conversion circuit 310 equipped with the booster contains a differential amplifier unit 91, an output amplifier unit 92, and an input unit 93. Thus it contains all of the circuit arrangements of the above-explained voltage follower circuit 72 shown in FIG. 12. Moreover, this impedance conversion circuit 310 equipped with the booster includes a booster 312 which is connected to the output amplifier unit 92 of the voltage follower circuit 72.

This booster 312 contains a first P-type MOS transistor QP41 and a second P-type MOS transistor QP42 between an output line VOUT of a first circuit 312 and a first power source voltage VDD. Furthermore, this booster 312 contains a first N-type MOS transistor QN41 and a second N-type MOS transistor QN42 between the output line VOUT of the first circuit 312 and a second power source voltage VSS.

A potential which is equal to a gate potential of a first P-type MOS transistor QP31 employed in the output amplifier unit 92 is supplied to a gate of the second P-type MOS transistor QP42. Similarly, a potential which is equal to a gate potential of a first N-type MOS transistor QN31 employed in the output amplifier unit 92 is supplied to a gate of the second N-type MOS transistor QN42.

A time period signal S2 is supplied to a gate of the first N-type MOS transistor QN41, and an inverted signal /S1 of the time period signal S1 is supplied to a gate of the first P-type MOS transistor QP41. As a result, when the signal level of this time period signal S1 is HIGH, both the first P-type MOS transistor QP41 and the second N-type MOS transistor QN42 are turned ON at the same time.

It should be understood that the P-type MOS transistors QP41 and QP42, which are provided in this booster 312, are larger than the P-type MOS transistor QP31 of the output power amplifier unit 92 in size. Similarly, it should also be understood that the N-type MOS transistors QN41 and QN42, which are provided in this booster 312, are larger than the N-type MOS transistor QN31 of the output power amplifier unit 92 in size. As a consequence, a second current drive capability of this booster 312 is greater than the first current drive capability of the voltage follower circuit 72.

In this case, the first current drive capability of the voltage follower circuit 72 is set in correspondence with a load capacitance due to the following reason. When the first current drive capability is excessively high, the load capacitance is charged so fast that the output voltage may be oscillated. Providing a phase compensation capacitance in the voltage follower circuit to avoid such an oscillation phenomenon causes to increase power consumption for every current used to charge/discharge this phase compensation capacitance. Under such a circumstance, in accordance with the present embodiment, the booster 312 is driven in the beginning stage of the charge time period, and the load is charged by way of both the first and second current drive capabilities so as to increase the charging speed of this load.

The time period signal S2 and the like are generated by employing the time period length setting circuit shown in FIG. 16, for example, a counter 320. This counter 320 may generate not only the time period signal S2, but also time period signals S1 and S3 capable of ON/OFF-controlling switches Q1 to Q3.

Figure 18:
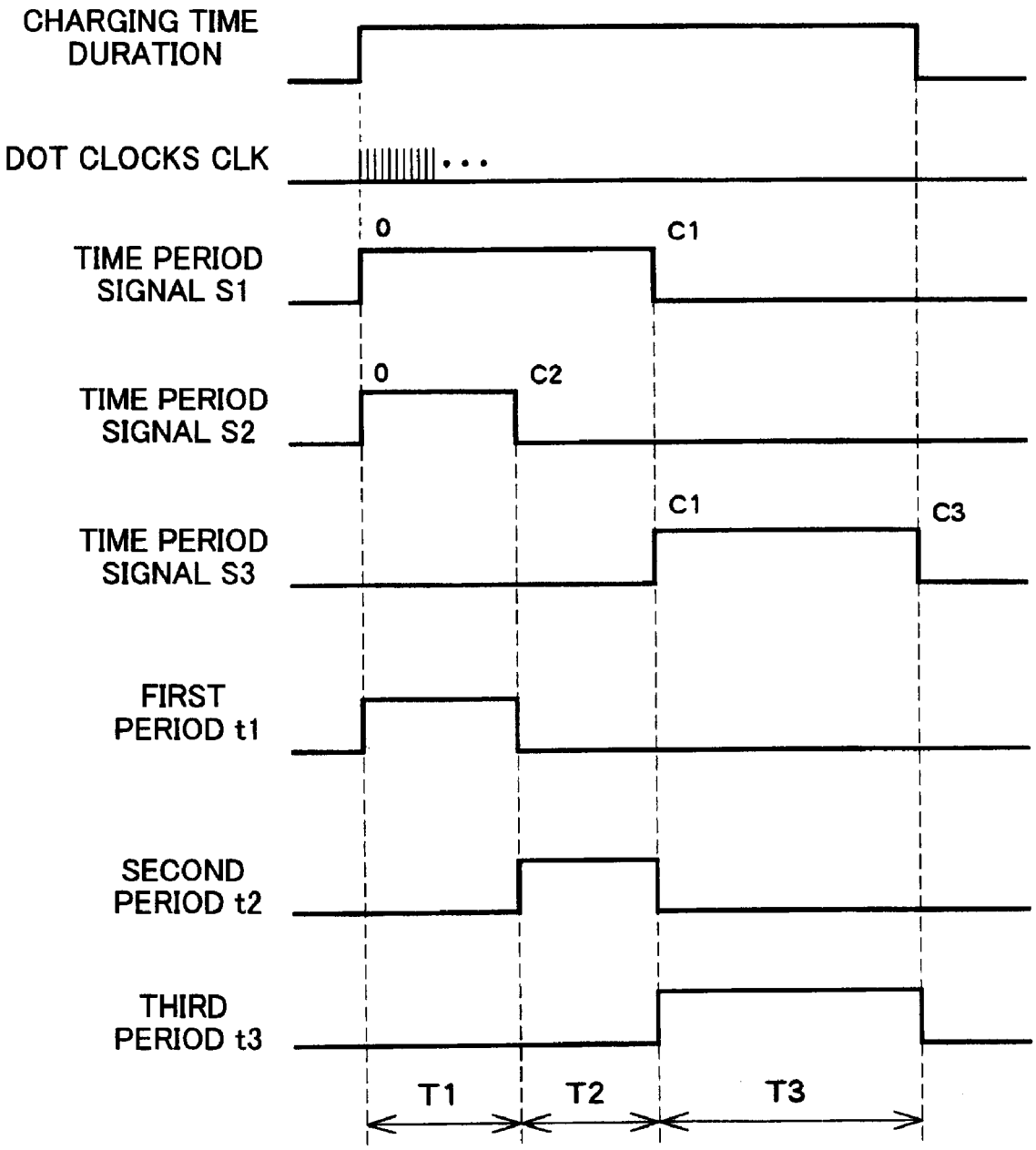
FIG. 18 shows a timing chart explaining the operations of the voltage supplying device shown in FIG. 16.

With reference to a timing chart shown in FIG. 18, the description now turns to the operations of this counter 320. As indicated in FIG. 18, this counter 320 counts dot clocks CLK which are inputted during the charge time period until total counting times reaches predetermined count values C1 to C3, respectively, and then, outputs the time period signals S1 to S3.

During an ON-time period (T1+T2) of the time period signal S1 indicated in FIG. 18, both the switches Q1 and Q3 shown in FIG. 16 are turned ON, so that the impedance conversion circuit 310 equipped with the booster is driven and then, an output signal of this impedance conversion circuit 310 equipped with the booster may become an output voltage $V_{out}$ via the switch Q1. In order to subdivide the ON-time period of this time period signal S1 into both a first period T1 and a second period T2, the counter 320 sets the time period signal S2 as an ON-time period (namely, first period T1) until a total number of the input dot clock CLK reaches the count value C2 (namely, C2<C1). Also, the counter 320 sets the time period signal S3 as an ON-time period (namely, third period T3) over a counting time period defined by the count value C1 up to the count value C3.

Figure 19:
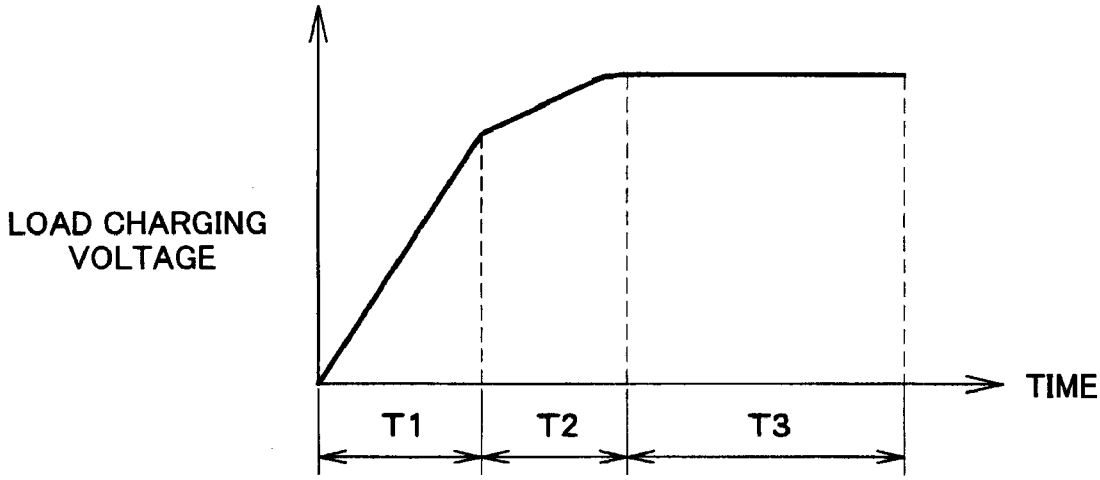
FIG. 19 is a graph showing a charge characteristic of a load which is charged by the voltage supplying device shown in FIG. 16.

At this time, as shown in FIG. 18, since the signal level of the time period S1 is HIGH in this first period T1, both the power source voltages VDD and VEE are supplied to the impedance conversion circuit 310 equipped with the booster. During this first period T1, the signal level of the time period signal S2 becomes HIGH, whereas the signal level of such a signal /S2 becomes LOW. The signal /S2 is produced by inverting the time period signal S2 by the inverter INV shown in FIG. 16. As a consequence, the transistors QP41 and QN41 represented in FIG. 16 are turned ON. As a result, the booster 312 is brought into a drive state, so that a current derived from the booster 312 is superimposed on the output from the output amplifier unit 92. As a result, as shown in FIG. 19, the load charging speed in the first period T1 may be increased.

When the first period T1 ends, the driving operation of this booster 312 stops. In the second period T2 subsequent to this first period T1, as represented in FIG. 18, since the signal level of the time period S1 is HIGH, both the power supply voltages VDD and VEE are supplied to the voltage follower circuit 72 of the impedance conversion circuit 310 equipped with the booster. As a result, since the load is charged only by using the first current drive capability of the voltage follower circuit 72 during this second period T2, the resulting load charging speed becomes lower than that of the above-explained first period T1.

Similar to the above-described embodiment, in a third period T3 subsequent to this second period T2, since the switch Q2 indicated in FIG. 16 is turned ON, an output of the DAC 70 is directly supplied to the load via a bypass path 205. During this third period T3, since the load is charged only by the current drive capability of this DAC 70, the resulting load charging speed is considerably lowered, as indicated in FIG. 19. However, during this third period T3, since the input/output offset of the impedance conversion circuit 310 equipped with the booster can be canceled, the load may be charged by using a correct final voltage.

Since the count values C1 and C2 are changed, a liquid crystal drive IC containing the circuit shown in FIG. 16 may be used for a wide variety of purposes. The IC may be commonly used in various types of liquid crystal panels with different horizontal scanning period (IH), charging period or load capacities and in various usage environments. For instance, if horizontal scanning period (IH) or charging period is short, a load of a liquid crystal panel is heavy, or if an environmental temperature is high, then the first period T1 and/or the first period and the second period (T1+T2) can be extended by user. As a consequence, the resulting load charging speed may increase. On the contrary, when the above-explained time periods are reduced, the resulting load charging speed may be delayed.

Figure 20:
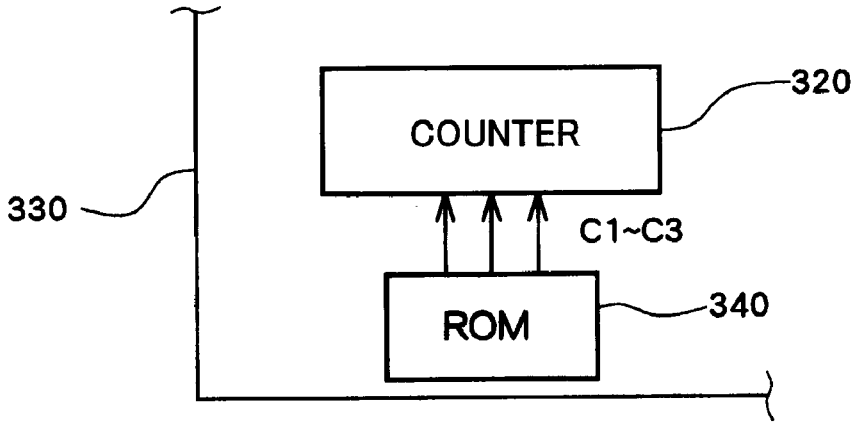
FIG. 20 is a diagram showing a liquid crystal drive IC containing a ROM used to set first to third period information.
Figure 21:
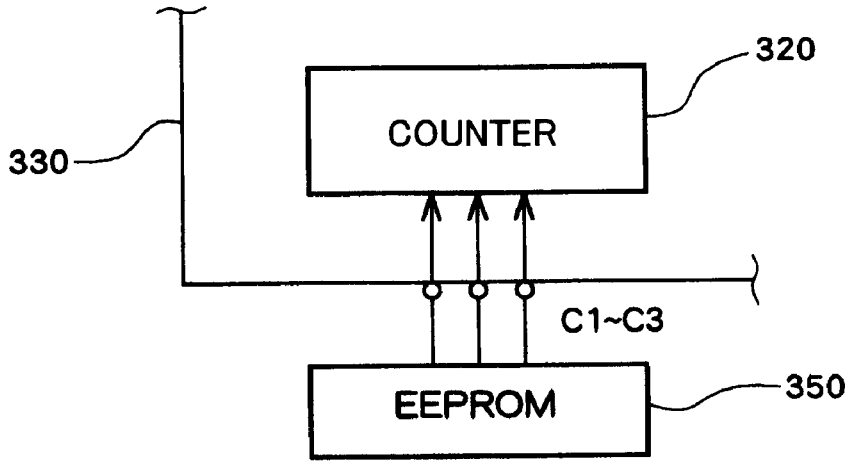
FIG. 21 is a diagram showing a liquid crystal drive IC externally equipped with an EEPROM used to set the first to third period information.
Figure 22:
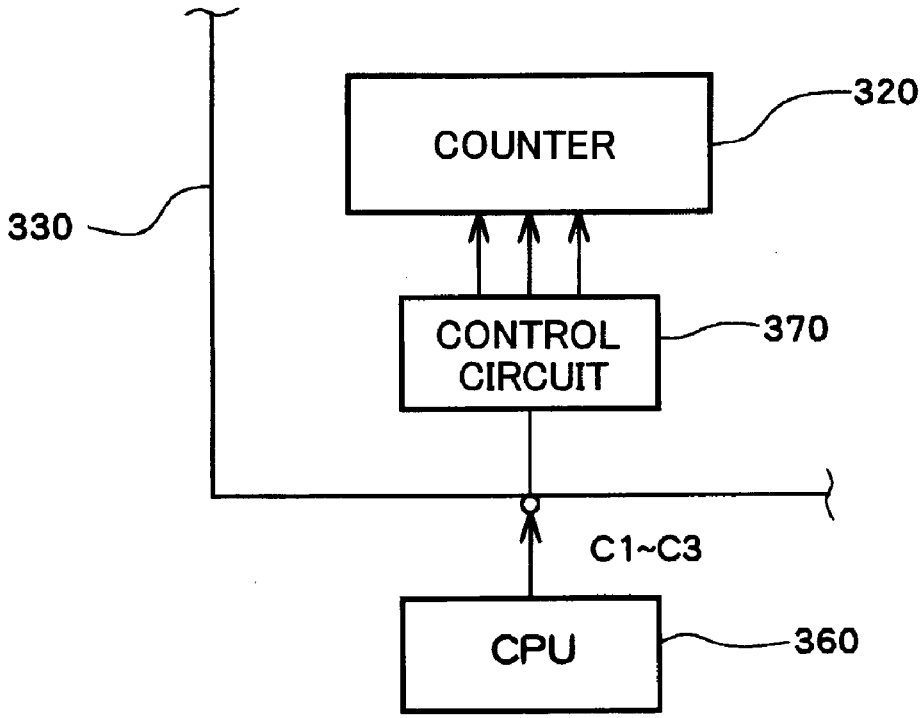
FIG. 22 is a diagram showing a liquid crystal drive IC into which the first to third period information are set by a CPU.

FIG. 20 to FIG. 22 illustrate the examples of the structures in which the above-explained count values C1 to C3 are set to a liquid crystal drive IC 330 containing the counter 320, respectively. In FIG. 20, while a ROM (read-only memory) 340 is built in this liquid crystal drive IC 330, the count values C1 to C3 read from this ROM 340 are supplied to the counter 320. In this case, the count values C1 to C3 which are adapted to a liquid crystal panel used with this liquid crystal drive IC 330 are set to the ROM 340 of this drive IC 330.

In FIG. 21, the count values C1 to C3 are set to such a memory which is externally connected to the liquid crystal IC 330, for example, an EEPROM (electrically erasable read-only memory) 350. In this case, while this IC 330 may be manufactured in a large quantity irrespective of type of a liquid crystal panel, the external EEPROM 350 may be manufactured in correspondence with a load of a liquid crystal panel and the like.

In FIG. 22, the count values C1 to C3 are supplied in response to a command issued from a CPU (central processing unit) 360, and then, these count values C1 to C3 are set to the counter 320 via a control circuit 370 which is provided inside the IC 330. These count values C1 to C3 may be set by either a manufacturer of a liquid crystal panel or an end user.

Figure 23:
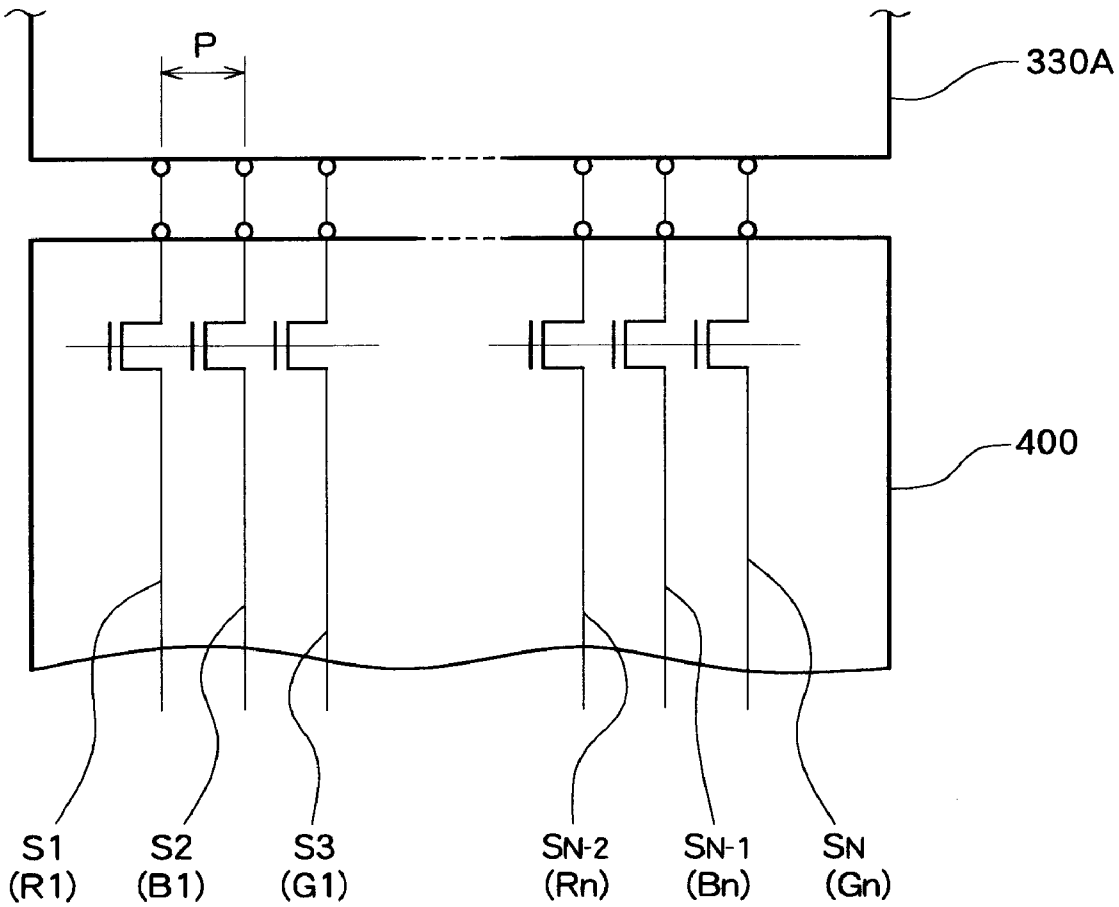
FIG. 23 is a diagram showing one example of a connection between a liquid crystal drive IC and a liquid crystal panel.
Figure 24:
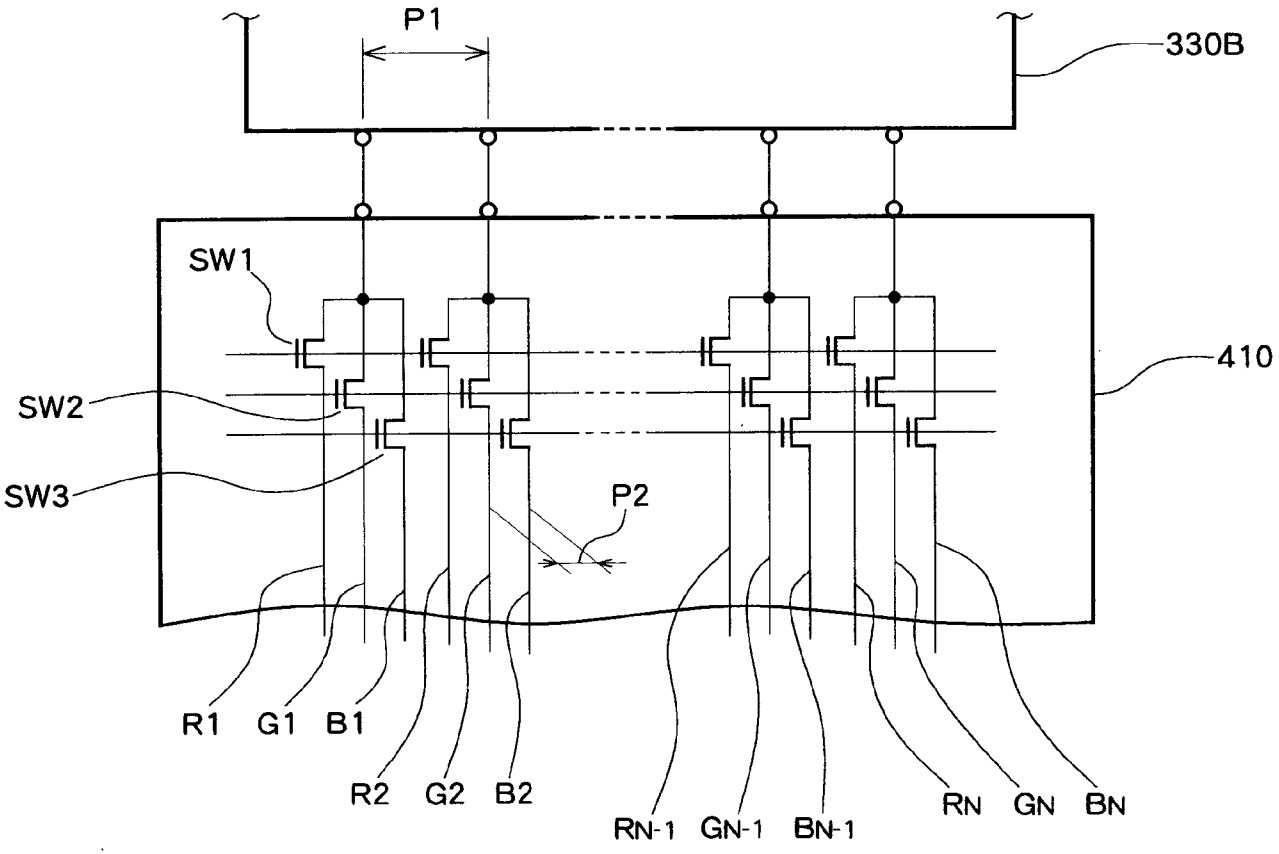
FIG. 24 is a diagram showing another example of a connection between a liquid crystal drive IC and a liquid crystal panel.

FIG. 23 and FIG. 24 schematically illustrate a liquid crystal panel 400 and another liquid crystal panel 410 having different loads. In the liquid crystal panel 400, each of N pieces of signal lines S1 to SN is connected to each of liquid crystal drive voltage terminals of a liquid crystal drive IC 330A. In such a case that the liquid crystal panel 400 is a color liquid crystal panel, a single signal line is used for any one of R, G, B color data. In the case that the liquid crystal panel 400 shown in FIG. 23 is driven, the charging time period shown in FIG. 18 corresponds to one horizontal scanning period (1H).

On the other hand, in the liquid crystal panel 410 shown in FIG. 24, three signal lines (R, G, B color data) are connected via switches SW1 through SW3 to each of liquid crystal drive voltage terminals of the liquid crystal drive IC 330B. With employment of such a structure, a pitch P2 of the signal lines employed in the liquid crystal panel 410 becomes narrower, as compared with a pitch P1 of IC terminals, and also this pitch P2 is also made narrower than a pitch P of the signal lines shown in FIG. 23. The liquid crystal panel structure as shown in FIG. 24, namely, a large number of switches are mounted inside the liquid crystal panel in a fine pitch, may be realized by way of such a liquid crystal panel 410 which is manufactured by utilizing a low-temperature polysilicon forming process.

Figure 25:
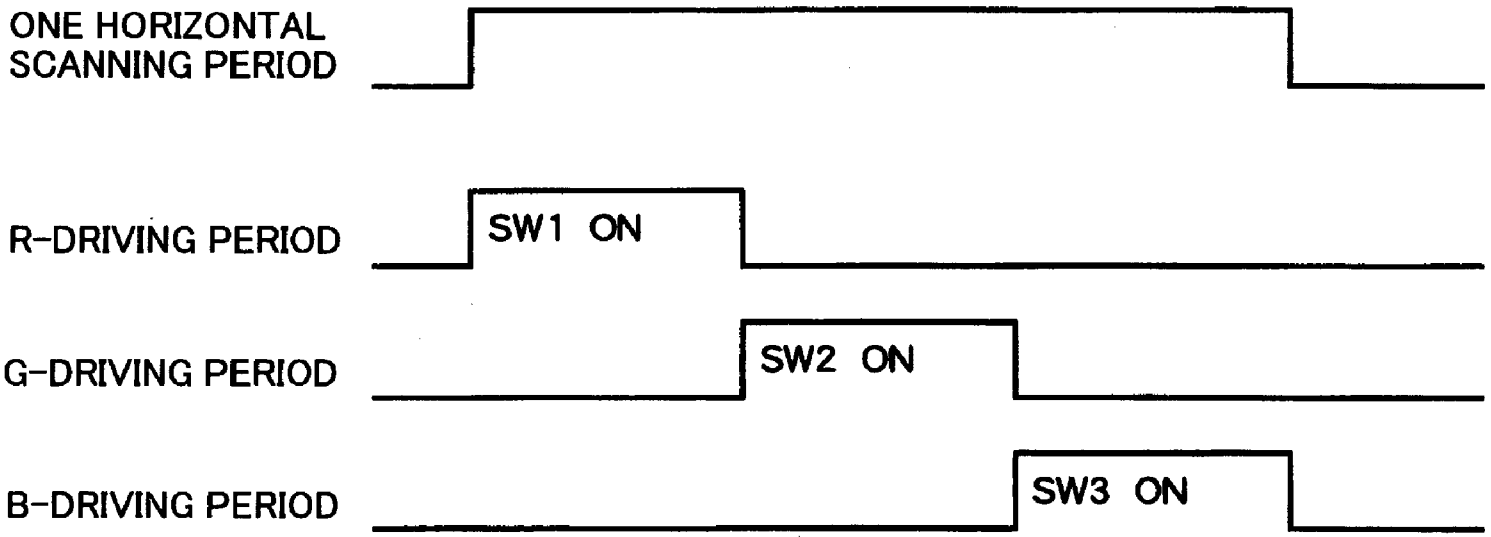
FIG. 25 is a timing chart showing one example of drive timing of the liquid crystal panel shown in FIG. 24.
Figure 26:
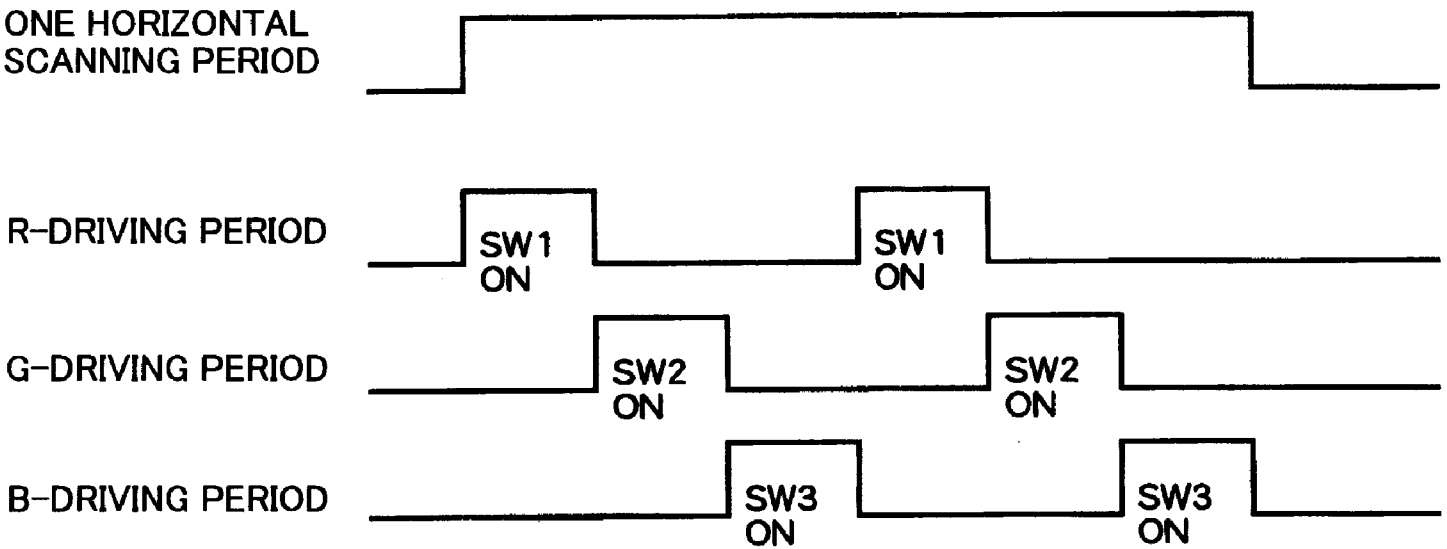
FIG. 26 is a timing chart showing another example of drive timing of the liquid crystal panel shown in FIG. 24.

The liquid crystal panel 410 indicated in FIG. 24 may be driven in such a driving manner as shown in FIG. 25, or FIG. 26. In FIG. 25, one horizontal scanning period (1H) is subdivided into three driving periods, namely, an R-driving period, a G-driving period, and a B-driving period. As a result, each color driving period is equal to 1H/3 and may constitute the charging time period shown in FIG. 18. On the other hand, in FIG. 26, one horizontal scanning period (1H) is subdivided into six driving periods, namely, two R-driving periods, two G-driving periods, and two B-driving periods. As a result, each other driving period is equal to 1H/6, and this color driving period may constitute the charging time period indicated in FIG. 18. In an actual case, since switch-OFF time periods are provided between the adjoining color driving periods, a charging time period of each color of the liquid crystal panel shown in FIG. 24 becomes considerably shorter than the charging time period (1H) of the liquid crystal panel indicated in FIG. 23.

As previously described, since the first period T1 to the third period T3 are set in response to a duration time of a charging time period, the load may be firmly charged up to a target voltage which is obtained by canceling input/output offset of an amplifier in a given charging time period.

Loads of liquid crystal panels may differ from each other, depending on the sizes of these liquid crystal panels and the total numbers of pixels thereof. Furthermore, these loads may be different from each other in accordance with materials of substrates such as an amorphous silicon substrate, and a polysilicon substrate which is manufactured by using a low-temperature polysilicon forming method. When the liquid crystal panel 400 shown in FIG. 23 is formed by employing an amorphous silicon substrate, a load capacitance per a single signal line may become large, i.e., 15 to 30 pF. When this liquid crystal panel 400 of FIG. 23 is formed by employing a polysilicon substrate, a load capacitance per a single signal line may become 4.8 pF, for instance. As previously explained, such a liquid crystal drive IC may be commonly used for various types of liquid crystal display panels with different load capacitances some of which being for instance three times to five times larger than others and require the circuit arrangement shown in FIG. 16. It should also be understood that in the case that a load of a liquid crystal panel is extremely low, this liquid crystal panel may be driven by omitting the first period T1.

As one example, in such a case that a liquid crystal panel VGA (640×480 pixels) having a size of 4 inches, which is manufactured by using a polysilicon substrate, is driven by employing a single liquid crystal drive IC, both the first period T1 and the second period T2 shown in FIG. 19 may be set to 1 μsec, respectively, whereas the third period T3 may be set to 3 μsec.

The invention can be applied to various kinds of electronic instrument, such as a portable phone, a game machine, an electronic organizer, a personal computer, a word processor, a television set and a vehicle navigation system.

What is claimed is:

1. A voltage supplying device comprising:

a voltage supplying source;

an impedance conversion circuit which performs impedance conversion for a voltage from the voltage supplying source and outputs the converted voltage;

a first switching element connected between the impedance conversion circuit and a load capacitance;

a bypass line for bypassing the impedance conversion circuit and the first switching element and supplying a voltage from the voltage supplying source to the load capacitance; and a second switching element provided on the bypass line, wherein the impedance conversion circuit includes:

a voltage follower circuit for outputting a voltage supplied from the voltage supplying source by a first current drive capability; and a booster provided at an output stage of the voltage follower circuit, for outputting a current to be added to an output of the voltage follower circuit by a second current drive capability;

wherein the first switching element is turned on and the second switching element is turned off in a first period of a charging period and a second period subsequent to the first period;

wherein the first switching element is turned off and the second switching element is turned on in a third period of the charging period subsequent to the second period;

wherein in the first period, the voltage follower circuit and the booster are driven so that a voltage is outputted from the impedance conversion circuit by the first current drive capability and the second current drive capability; and wherein in the second period, the voltage follower circuit is driven so that a voltage is outputted from the impedance conversion circuit by the first current drive capability.

2. The voltage supplying device as defined in claim 1, further comprising a time period length setting circuit for setting time period lengths of the first, second and third periods.

3. The voltage supplying device as defined in claim 2, wherein the time period length setting circuit variably changes the lengths of the first, second and third periods based on information supplied from outside an IC on which the voltage supplying device is mounted.

4. The voltage supplying device as defined in claim 1, wherein there is a period in which both the first and second switching elements are turned off.

5. The voltage supplying device as defined in claim 1, further comprising a third switching element connected on a power source line which supplies a power source voltage to the impedance conversion circuit, wherein the third switching element is turned off, synchronized with an off operation of the first switching element.

6. The voltage supplying device as defined in claim 1, wherein when an input voltage having a magnitude near a power source potential VDD is input to the voltage follower circuit, the voltage follower circuit has a property in which an output voltage is saturated and shows no linear characteristics in response to an input voltage; and wherein a voltage from the voltage supplying source is supplied to the load capacitance through the bypass line by turning off the first switching element and turning on the second switching element in a saturated region of an output voltage of the voltage follower circuit.

7. The voltage supplying device as defined in claim 6, wherein when an input voltage having a magnitude near a ground potential VEE is input to the voltage follower circuit, the voltage follower circuit has a property in which an output voltage is saturated and shows no linear characteristics in response to an input voltage; and wherein a voltage from the voltage supplying source is supplied to the load capacitance through the bypass line by turning off the first switching element and turning on the second switching element in a saturated region of an output voltage of the voltage follower circuit.

8. A semiconductor device comprising the voltage supplying device as defined in claim 1.

9. The semiconductor device as defined in claim 8, further comprising a time period length setting circuit for setting lengths of the first, second and third periods which variably changes the lengths of the first, second and third periods based on information supplied from outside the semiconductor device.

10. An electro-optical device comprising:

a display section having an electro-optical element; and a driver IC for driving a signal line of the display section, wherein the driver IC comprises a voltage supplying device which supplies a voltage to a load capacitance to finish charging the load capacitance with a predetermined voltage within a predetermined charging period; and wherein the voltage supplying device comprises:

a voltage supplying source;

an impedance conversion circuit which performs impedance conversion for a voltage from the voltage supplying source and outputs the converted voltage;

a first switching element connected between the impedance conversion circuit and the load capacitance;

a bypass line for bypassing the impedance conversion circuit and the first switching element and supplying a voltage from the voltage supplying source to the load capacitance; and a second switching element provided on the bypass line, wherein the impedance conversion circuit includes:

a voltage follower circuit for outputting a voltage supplied from the voltage supplying source by a first current drive capability; and a booster provided at an output stage of the voltage follower circuit, for outputting a current to be added to the output of the voltage follower circuit by a second current drive capability;

wherein the first switching element is turned on and the second switching element is turned off in a first period of the charging period and a second period subsequent to the first period;

wherein the first switching element is turned off and the second switching element is turned on in a third period of the charging period subsequent to the second period;

wherein in the first period, the voltage follower circuit and the booster are driven so that a voltage is outputted from the impedance conversion circuit by the first current drive capability and the second current drive capability; and wherein in the second period, the voltage follower circuit is driven so that a voltage is outputted from the impedance conversion circuit by the first current drive capability.

11. The electro-optical device as defined in claim 10, further comprising a time period length setting circuit for setting lengths of the first, second and third periods based on a dot clock.

12. The electro-optical device as defined in claim 11, wherein the time period length setting circuit includes an information supplying circuit for setting length information of the first, second and third periods.

13. The electro-optical device as defined in claim 12, wherein the information supplying circuit is provided outside the driver IC.

14. The electro-optical device as defined in claim 13, wherein the information supplying circuit variably changes the length information of the first, second and third periods.

15. The electro-optical device as defined in claim 10, wherein the electro-optical element is driven based on grayscale voltages from the voltage supplying device;

wherein the voltage supplying source is formed of a digital-analog converter which converts a digital grayscale signal to an analogue voltage; and wherein the first and second periods are finished after the load capacitance is charged with a voltage which has a magnitude within a range corresponding to half of the least signification bit with respect to a desired grayscale voltage value to be supplied to the electro-optical element and which has a magnitude of 90% or more of the desired grayscale voltage value.

16. An electronic instrument comprising the electro-optical device as defined in claim 10.

17. A voltage supplying device comprising:

a voltage supplying means;

an impedance conversion means for performing impedance conversion for a voltage from the voltage supplying means and outputting the converted voltage;

a first switching means connected between the impedance conversion means and a load capacitance;

a bypass line for bypassing the impedance conversion means and the first switching means and supplying a voltage from the voltage supplying means to the load capacitance; and a second switching means provided on the bypass line, wherein the impedance conversion means includes:

a voltage follower means for outputting a voltage supplied from the voltage supplying means by a first current drive capability; and a booster provided at an output stage of the voltage follower means, for outputting a current to be added to an output of the voltage follower means by a second current drive capability;

wherein the first switching means is turned on and the second switching means is turned off in a first period of a charging period and a second period subsequent to the first period;

wherein the first switching means is turned off and the second switching means is turned on in a third period of the charging period subsequent to the second period;

wherein in the first period, the voltage follower means and the booster are driven so that a voltage is outputted from the impedance conversion means by the first current drive capability and the second current drive capability; and wherein in the second period, the voltage follower means is driven so that a voltage is outputted from the impedance conversion means by the first current drive capability.

18. A method for supplying a voltage supplying comprising:

performing impedance conversion by an impedance conversion circuit for a voltage from a voltage supplying source and outputting the converted voltage;

connecting a first switching element between the impedance conversion circuit and a load capacitance;

bypassing the impedance conversion circuit and the first switching element and supplying a voltage from the voltage supplying source to the load capacitance;

providing a second switching element provided on a bypass line;

outputting a voltage supplied from the voltage supplying source by a first current drive capability;

outputting a current to be added to an output of a voltage follower circuit by a second current drive capability;

turning on the first switching element and turning off the second switching element in a first period of a charging period and a second period subsequent to the first period;

turning off the first switching element and turning on the second switching element in a third period of the charging period subsequent to the second period;

driving in the first period, the voltage follower circuit and a booster so that a voltage is outputted from the impedance conversion circuit by the first current drive capability and the second current drive capability; and driving in the second period, the voltage follower circuit so that a voltage is outputted from the impedance conversion circuit by the first current drive capability.

19. The method as defined in claim 18 further comprising setting time period lengths of the first, second and third periods.

20. The method as defined in claim 19 further comprising changing the lengths of the first, second and third periods based on information supplied from outside an IC on which the voltage supplying device is mounted.

21. The method as defined in claim 18 further comprising turning off both the first and second switching elements.

22. The method as defined in claim 18 further comprising connecting a third switching element on a power source line which supplies a power source voltage to the impedance conversion circuit and turning off the third switching element synchronized with an off operation of the first switching element.

* * * * *